US006776740B1

(12) United States Patent
Anderson et al.

(10) Patent No.: US 6,776,740 B1
(45) Date of Patent: Aug. 17, 2004

(54) TREADMILL MECHANISM

(75) Inventors: Timothy T. Anderson, Antioch, IL (US); Shawn Barrett, Grayslake, IL (US); Christopher E. Clawson, Palatine, IL (US); Thomas B. Cray, Chicago, IL (US); Juliette Cherly Daly, Chicago, IL (US); Peter Haugen, Edon Prarie, MN (US); Edward Honda, Chicago, IL (US); John Jung Hsing, Glendale Heights, IL (US); Edward Minnich, Grayslake, IL (US); Angela Martin, Chicago, IL (US); Paul D. Osenkarski, Westmont, IL (US); Jeffrey J. Partynski, Lockport, IL (US); Timothy J. Porth, Bloomington, MN (US); Thomas F. Smith, Jr., Downers Grove, IL (US); Daniel R. Wille, St. Louis Park, MN (US); Chungkin Yee, Kenosha, WI (US); Gary E. Oglesby, Manhattan, IL (US)

(73) Assignee: Brunswick Corporation, Lake Forest, IL (US)

( * ) Notice: Subject to any disclaimer, the term of this patent is extended or adjusted under 35 U.S.C. 154(b) by 419 days.

(21) Appl. No.: 09/651,247

(22) Filed: Aug. 30, 2000

Related U.S. Application Data

(60) Provisional application No. 60/159,268, filed on Oct. 13, 1999, and provisional application No. 60/152,657, filed on Sep. 7, 1999.

(51) Int. Cl.[7] ..... A63B 22/00
(52) U.S. Cl. ..... 482/54; 482/51
(58) Field of Search ..... 482/51, 54

(56) References Cited

U.S. PATENT DOCUMENTS

| | | | | |
|---|---|---|---|---|
| 4,344,616 A | | 8/1982 | Ogden | |
| 4,364,556 A | | 12/1982 | Otte | |
| 4,445,683 A | | 5/1984 | Ogden | |
| 4,635,928 A | | 1/1987 | Ogden et al. | |
| 5,100,127 A | | 3/1992 | Melnick et al. | |
| 5,141,479 A | * | 8/1992 | Vanjani et al. | 482/54 |
| 5,336,144 A | | 8/1994 | Rodden | |
| 5,336,145 A | | 8/1994 | Keiser | |
| 5,433,679 A | * | 7/1995 | Szymczak et al. | 482/54 |

(List continued on next page.)

FOREIGN PATENT DOCUMENTS

| | | | |
|---|---|---|---|
| EP | 0196877 | 10/1986 | A63B/23/06 |
| WO | WO8907473 | 8/1989 | A63B/26/06 |

*Primary Examiner*—Glenn E. Richman
(74) *Attorney, Agent, or Firm*—Michael B. McMurry

(57) ABSTRACT

An exercise treadmill is disclosed which includes various features to enhance user operation and to reduce maintenance costs. These features include handlebars with an upwardly curved center section and outwardly flared side portions along with pivoting rear legs for the treadmill frame. The control panel features include snap-in user trays and an overlay covering the numerical key pad along with an auxiliary control panel having a subset of user controls that are larger and more easy to use than the same controls on the main control panel. Maintenance enhancing features include the provision for access panels in the treadmill housing and a belt lubrication system that uses a priming pulse to clear the wax spraying nozzle. For injection molded parts such as the control panel, structural strength is enhanced by utilizing gas-assist injection molding to form structural ribs. Another feature includes pre-glazing the treadmill belt. Sound and vibration are reduced in a treadmill by mounting the treadmill belt drive motor on motor isolation mounts that include resilient members. A further feature is a double sided waxed deck where one side of the deck is covered by a protective tape.

30 Claims, 21 Drawing Sheets

U.S. PATENT DOCUMENTS

| | | | | | |
|---|---|---|---|---|---|
| 5,441,468 | A | | 8/1995 | Deckers et al. | |
| 5,476,430 | A | | 12/1995 | Lee et al. | |
| 5,509,872 | A | * | 4/1996 | Chen | 482/54 |
| 5,643,144 | A | * | 7/1997 | Trulaske | 482/54 |
| 5,752,897 | A | | 5/1998 | Skowronski et al. | |
| 6,077,200 | A | * | 6/2000 | Lin | 482/54 |
| 6,123,646 | A | | 9/2000 | Colassi | 482/54 |
| 6,171,216 | B1 | | 1/2001 | Wang et al. | 482/54 |
| 6,174,267 | B1 | | 1/2001 | Dalebout et al. | 482/54 |
| 6,241,638 | B1 | | 6/2001 | Hurt | 482/54 |
| 6,254,515 | B1 | | 7/2001 | Carman et al. | 482/54 |
| 6,350,218 | B1 | * | 2/2002 | Dalebout et al. | 482/54 |

* cited by examiner

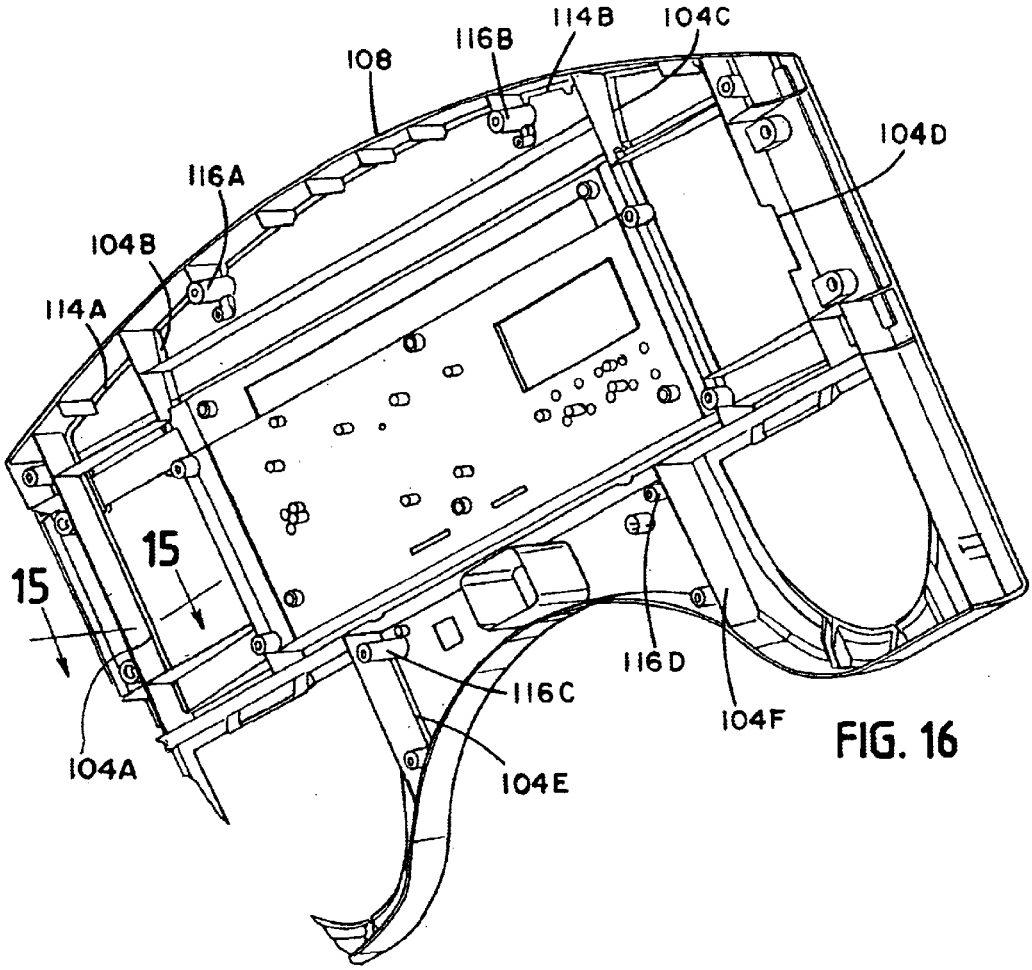
FIG. 16
FIG. 15
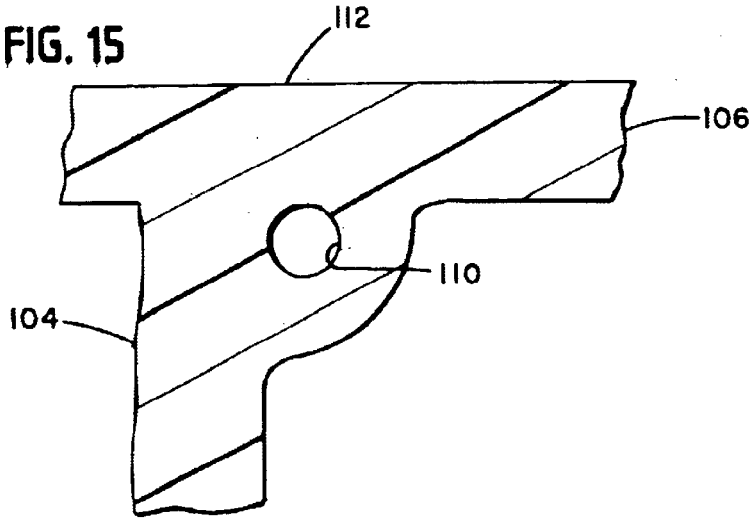

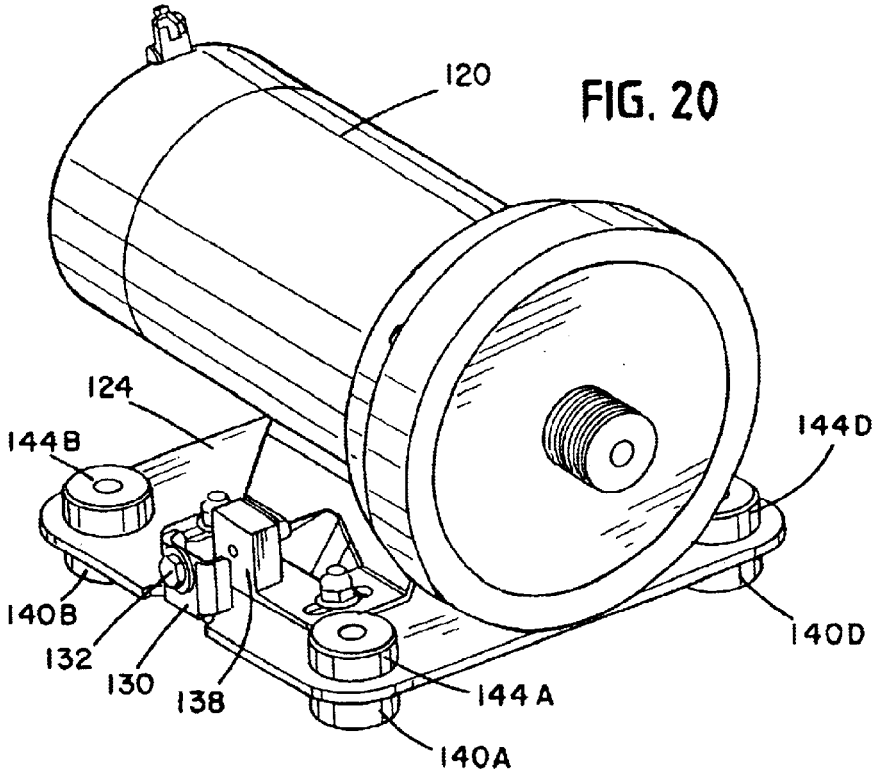
FIG. 20
FIG. 21
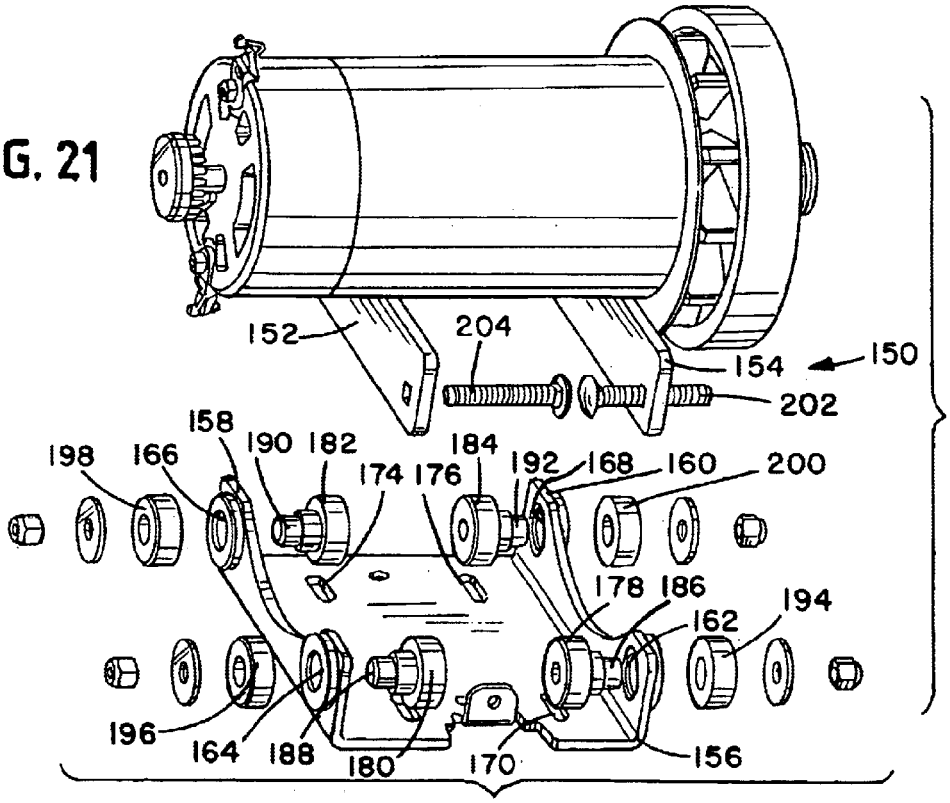

120
202
152
174
204
154
202
196
180
194
150
156
172
170
178

222
220
212
146
216
208
210H
210G
210F
210E
210D
210C
210B
208
210A
120

TREADMILL MECHANISM

This application claims the benefit of Provisional application Ser. No. 60/152,657, filed Sep. 7, 1999, and No. 60/159,268, filed Oct. 13, 1999.

FIELD OF THE INVENTION

This invention generally relates to exercise equipment and in particular to exercise treadmills

BACKGROUND OF THE INVENTION

Exercise treadmills are widely used for performing walking or running aerobic-type exercise while the user remains in a relatively stationary position. In addition exercise treadmills are used for diagnostic and therapeutic purposes. Generally, for all of these purposes, the person on the treadmill performs an exercise routine at a relatively steady and continuous level of physical activity. One example of such a treadmill is provided in U.S. Pat. No. 5,752,897.

Although exercise treadmills have reached a relatively high state of development, there are a number of significant improvements in the mechanical structure of a treadmill that can improve the user's exercise experience as well improve the maintainability and reduce the cost of manufacture of treadmills.

SUMMARY OF THE INVENTION

It is therefore an object of the invention to provide an exercise treadmill having an improved mechanical arrangement.

It is also an object of the invention to provide an exercise treadmill with an upwardly curving center handlebar that allows the user to grasp the handlebar at a number of different heights and provides additional knee room for a user running on the treadmill.

An additional object of the invention is to provide an exercise treadmill with a pair of side hand rails where the rear portions flair outwardly.

Another object of the invention is to provide an exercise treadmill with pivoting rear legs.

Still another object of the invention is to provide an exercise treadmill having a snap-in accessory tray.

An additional object of the invention is to provide a removable overlay over certain portions of a treadmill control panel such as a key pad.

It is still another object of the invention to provide a treadmill having a control panel that includes user controls with an auxiliary control panel having a subset of the user controls.

It is also an object of the invention to provide a housing covering a treadmill frame with an access panel to provide ready access to various components of the treadmill including in some treadmills components of a belt lubrication system.

Additionally, it is an object of the invention to provide a treadmill belt lubrication system, where a lubricant such as wax is sprayed on the belt from a nozzle, with a mechanism for spraying a priming pulse of the lubricant through the nozzle of the system prior to the normal belt spraying operation of the system.

A further object of the invention is to provide an exercise treadmill having a control panel having support ribs formed from gas-assist molded injected plastic.

Still another object of the invention is to provide a treadmill with a belt having a pre-glazed surface.

Yet another object of the invention is to provide an exercise treadmill having a motor connected to a pulley for moving a belt where the motor is secured to the frame of the treadmill by a mounting structure that includes resilient members to isolate the frame from motor vibration.

A further object of the invention is to provide an exercise treadmill with a double sided deck having its under side covered by a protective tape to protect the waxed surface.

BRIEF DESCRIPTION OF THE DRAWINGS

FIG. 15 is a sectioned drawing of a portion of the exercise treadmill of FIG. 1 illustrating the formation of a structural rib formed by gas-assist injection molding;

FIG. 16 is a top plan view of a lower housing of the control panel of FIG. 10 illustrating structural components formed by the gas-assist injection molding method of FIG. 15;

FIG. 20 is an assembled perspective view of the motor isolation mount of FIG. 18;

FIG. 21 is an exploded perspective view of a second embodiment of a motor isolation mount;

DETAILED DESCRIPTION OF THE INVENTION

Figure 1:
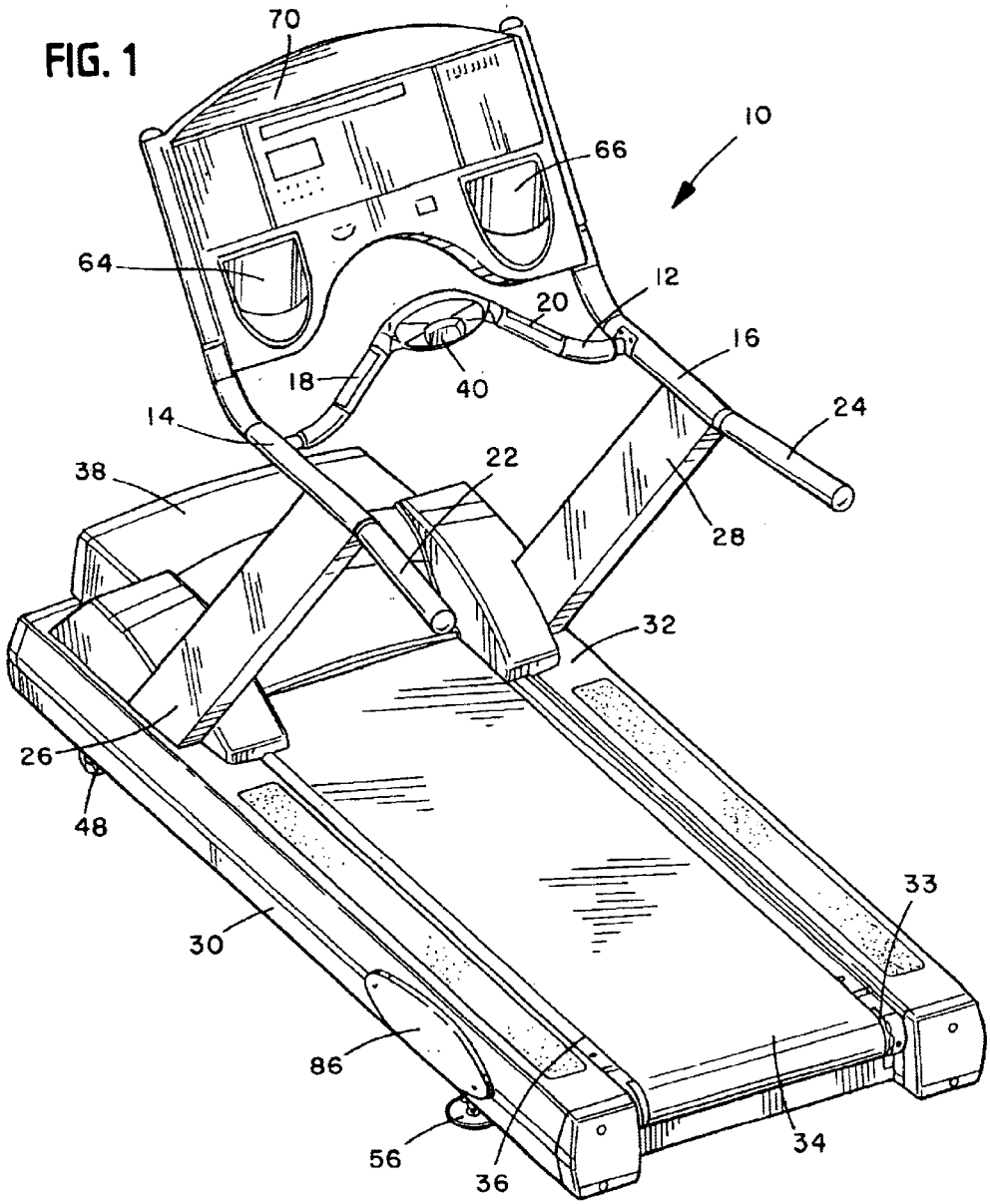
FIG. 1. is a perspective view of an assembled exercise treadmill according to the invention.

FIG. 1 shows the general outer configuration of an exercise treadmill 10, according to the invention, where the treadmill includes a central arm handle 12 that extends upwardly from a pair of side handrails 14 and 16. In the preferred embodiment of the invention, the central arm handle 12 is curved in the general shape of an arc. By providing an upward extension in the center arm handle 12, it makes it possible for treadmill users to grasp the central handle 12 in a number of different vertical locations and also accommodates the knees of users who might be running close to the front of the treadmill 10. Included in the central arm handle 12 in one embodiment of the invention are a pair of electrodes 18 and 20 for obtaining the user's heart rate as generally taught in Leon et al, U.S. Pat. No. 5,365,934. A more detailed view of the arm handle 12 is provided in FIGS. 23–27. One advantage of placing the electrodes 18 and 20 on the upward extending portions of the central arm handle 12 as shown in FIG. 1 is that it makes it significantly more convenient for some users to grasp the electrodes 18 and 20 while running on the treadmill 10.

Figure 2:
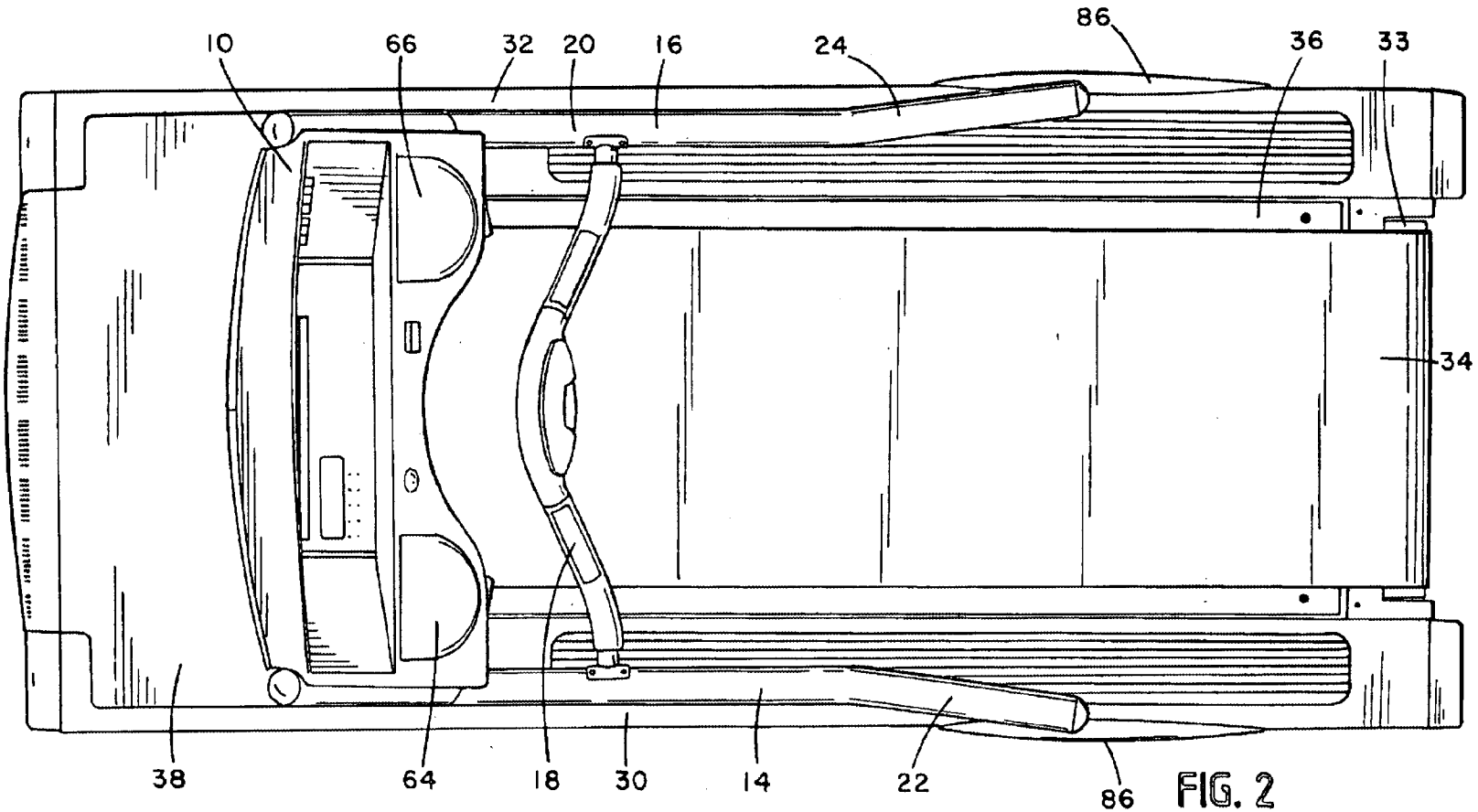
FIG. 2 is a top plan view of the assembled exercise treadmill of FIG. 1 illustrating the outward flare of a pair of side arm handles.
Figure 3:
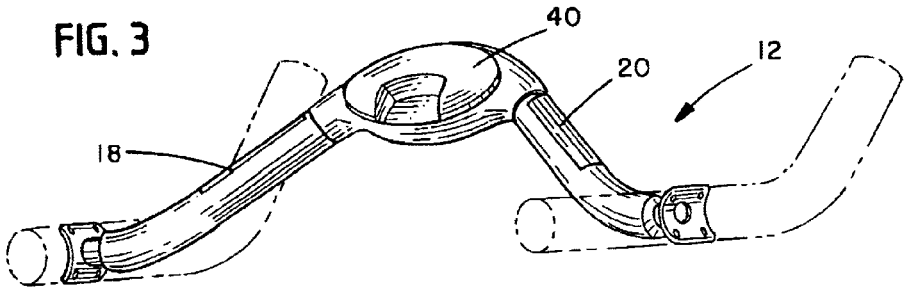
FIGS. 3–7 are views of a central arm handle of the treadmill of FIG. 1.
Figure 4A:
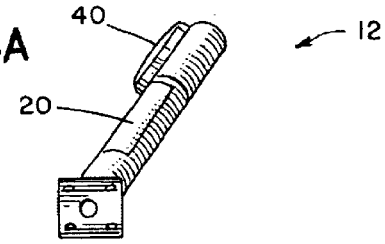
Figure 4B:
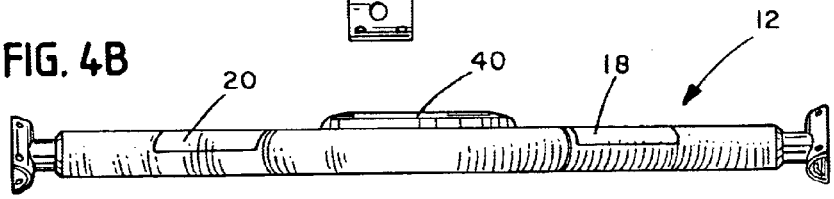
Figure 5:
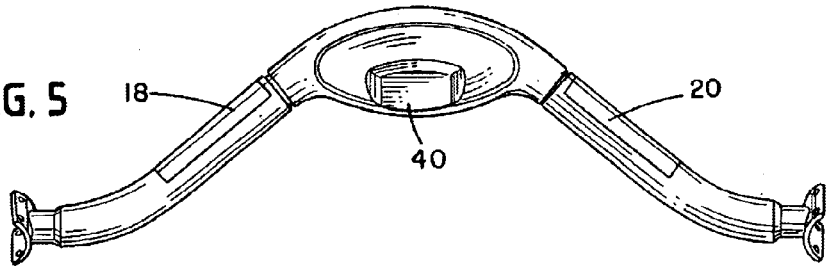
Figure 6:
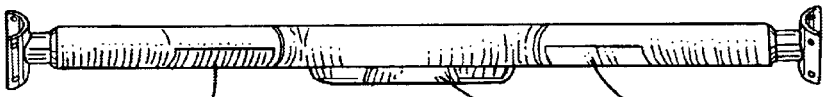
Figure 7:
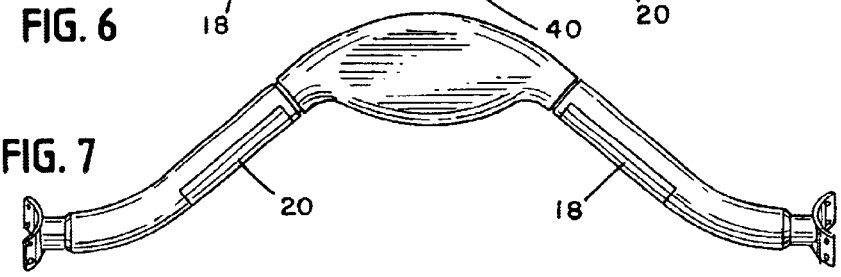
Figure 8B:
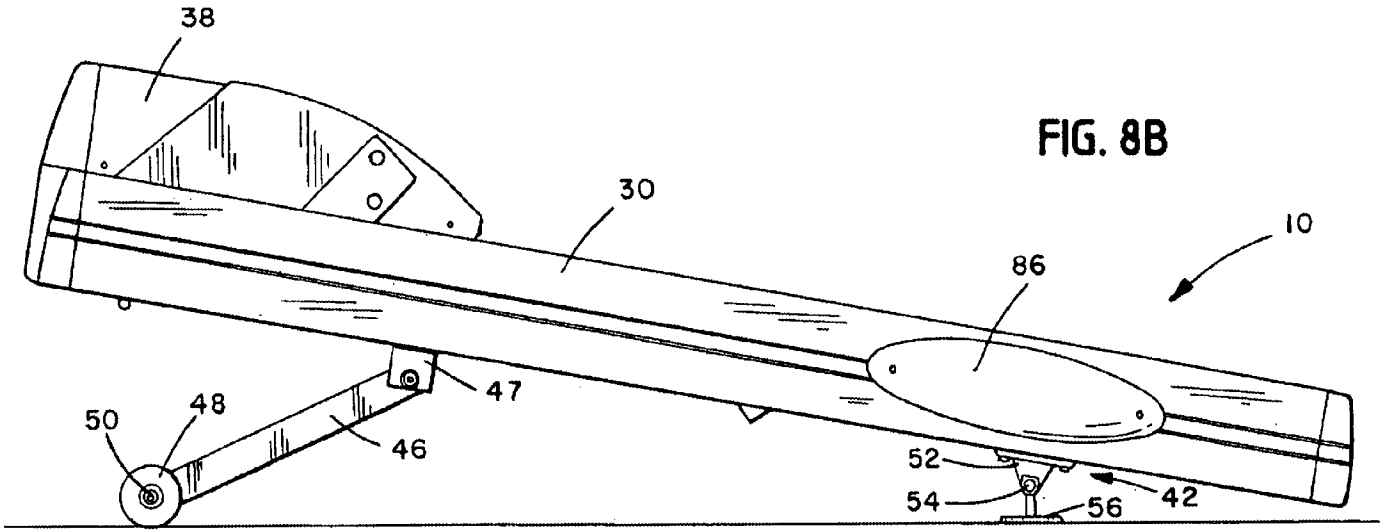
FIGS. 8A–B are side views of the treadmill of FIG. 1 illustrating a pivoting rear foot assembly.
Figure 8A:
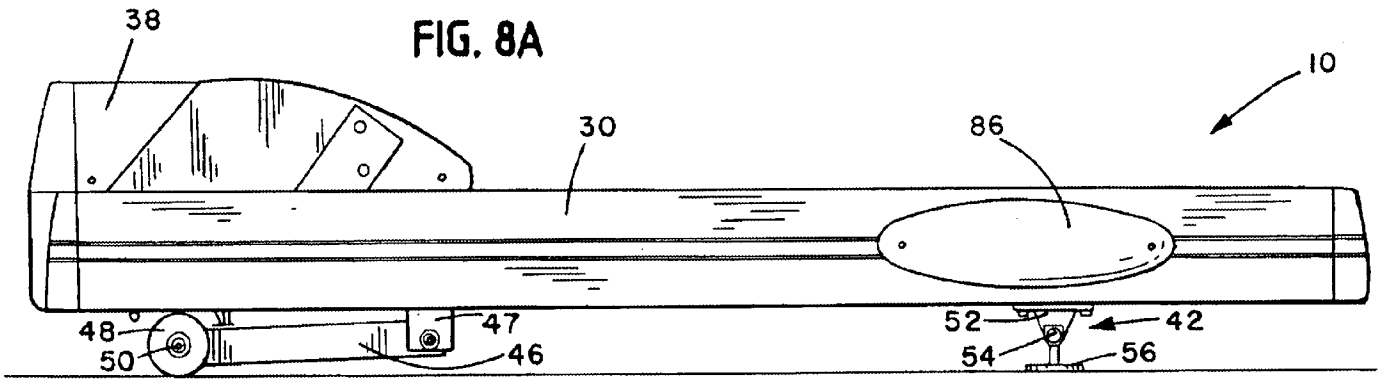

FIGS. 1 and 2 illustrate another feature of the invention where each of the side handrails 14 and 16 have a rear portion 22 and 24 respectively that flare outwardly. In the preferred embodiment of the invention, the side handrails 14 and 16 are secured to a pair of handrail support members 26 and 28 respectively that extend upwardly from the frame (not shown) of the treadmill 10. As is conventional in exercise treadmill design, the treadmill frame includes a pair of longitudinal frame members (not shown) that are concealed by a pair of frame housings 30 and 32. The longitudinal frame members support a pair of pulleys, such as 33, over which a belt 34 is rotatably mounted for longitudinal movement and supported by a deck 36 which in turn is supported on the frame. An example of such a design is shown in U.S. Pat. No. 5,752,897. One advantage of the flared portions 22 and 24 of the side handrails 14 and 16 is that it reduces interference with the user's hands as he runs on the treadmill. Also, the handrail support members 26 and 28 extend at an angle rearwardly from the forward end of the treadmill 10 adjacent to a motor housing 38 in order to reduce potential interference with the user's feet.

FIGS. 3–7 provide a detailed illustration of the preferred embodiment of the central arm handle 12. In this embodiment, the central arm handle 12 includes a sensor housing 40 that can be configured to contain an infrared sensor for determining if a user is on the treadmill belt 34.

Figure 9A:
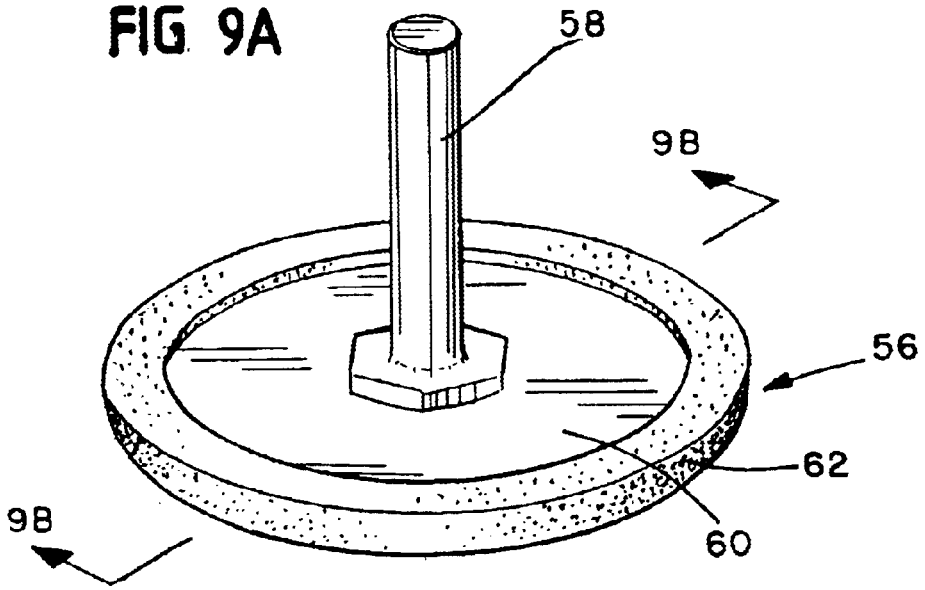
FIG. 9A is a perspective view of a pad assembly for use with the pivoting foot assembly of FIG. 8.
Figure 9B:
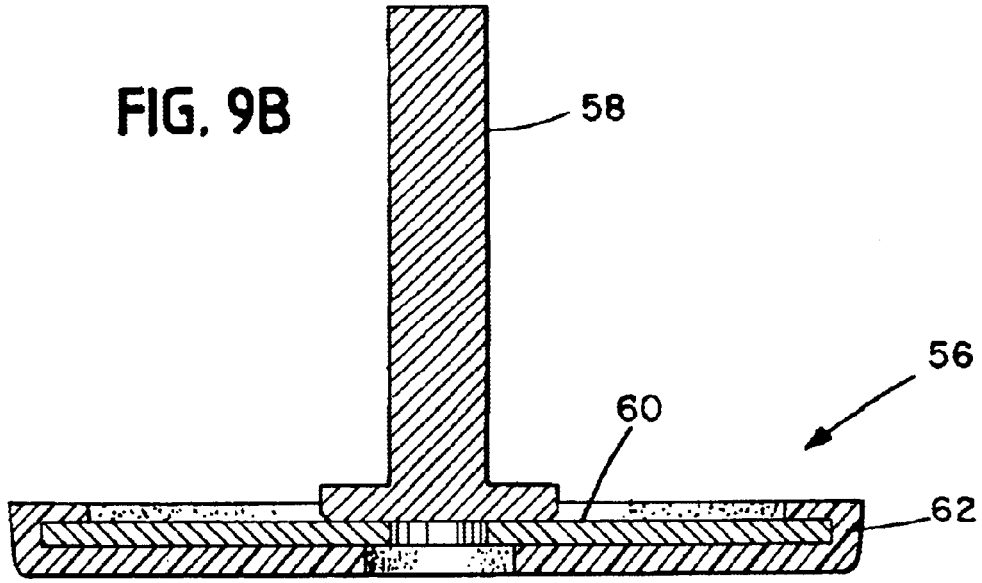
FIG. 9B is a sectioned side view of the pad assembly for use with the pivoting foot assembly of FIG. 9A.

FIGS. 8A–B and 9A–B show a pivot mechanism 42 which forms part of a rear foot assembly on the treadmill 10. This overcomes the common problem of wear and tear on floor surfaces as a result of treadmill wheel and foot movement. Typical treadmills feature an inclination mechanism that include a pair of power lift arms, such as the one shown at 46, that pivot about a pair of supports such as 47 near the front of the treadmill 10 and fixed rear feet attached, of the type shown on the treadmill 10' in FIG. 18, near the rear of the treadmill 10'. The lift arm 46 is typically fitted with a pair of wheels 48 rotatably mounted on an axle 50. In most treadmills, the treadmill inclines by tilting on fixed rear feet about a point on the floor as the lift arm 46 inclines the treadmill 10. This action results in wheel movement in the longitudinal direction of the treadmill 10. The amount of wheel movement is dependent on the relative positions of the pivot point to each other, including the height of the wheel axle 50 compared to the fixed rear foot pivot point. In most cases, the front wheels 48 will roll to the rearward. However, in the preferred embodiment of the invention, by moving the rear pivot point up from the floor utilizing the pivot mechanism 42, the movement of the front wheels 48 can be controlled so that their movement occurs both forward and rearward during the inclining of the treadmill 10. The preferred embodiment of the pivot mechanism 42 includes a bracket 52 and a pin 54 rotatably secured within the bracket 52 with a floor pad 56 attached to the pin 54. FIG. 9A is a perspective view and FIG. 9B is a sectioned side view of the preferred structure of the pad 56 and also depicts a support member such as a screw 58 for attaching the pad 56 to the pin 54. The pad 56 itself includes a circular plate 60 and a rubber overmold 62 covering the lower surface of the pad 56. In addition to reducing the overall movement of the wheel 48 on the floor, the use of the pivot mechanism 42 will permit the use of the flat pad 56 on the bottom of the assembly 46 thus eliminating edge loading on the floor.

Figure 10:
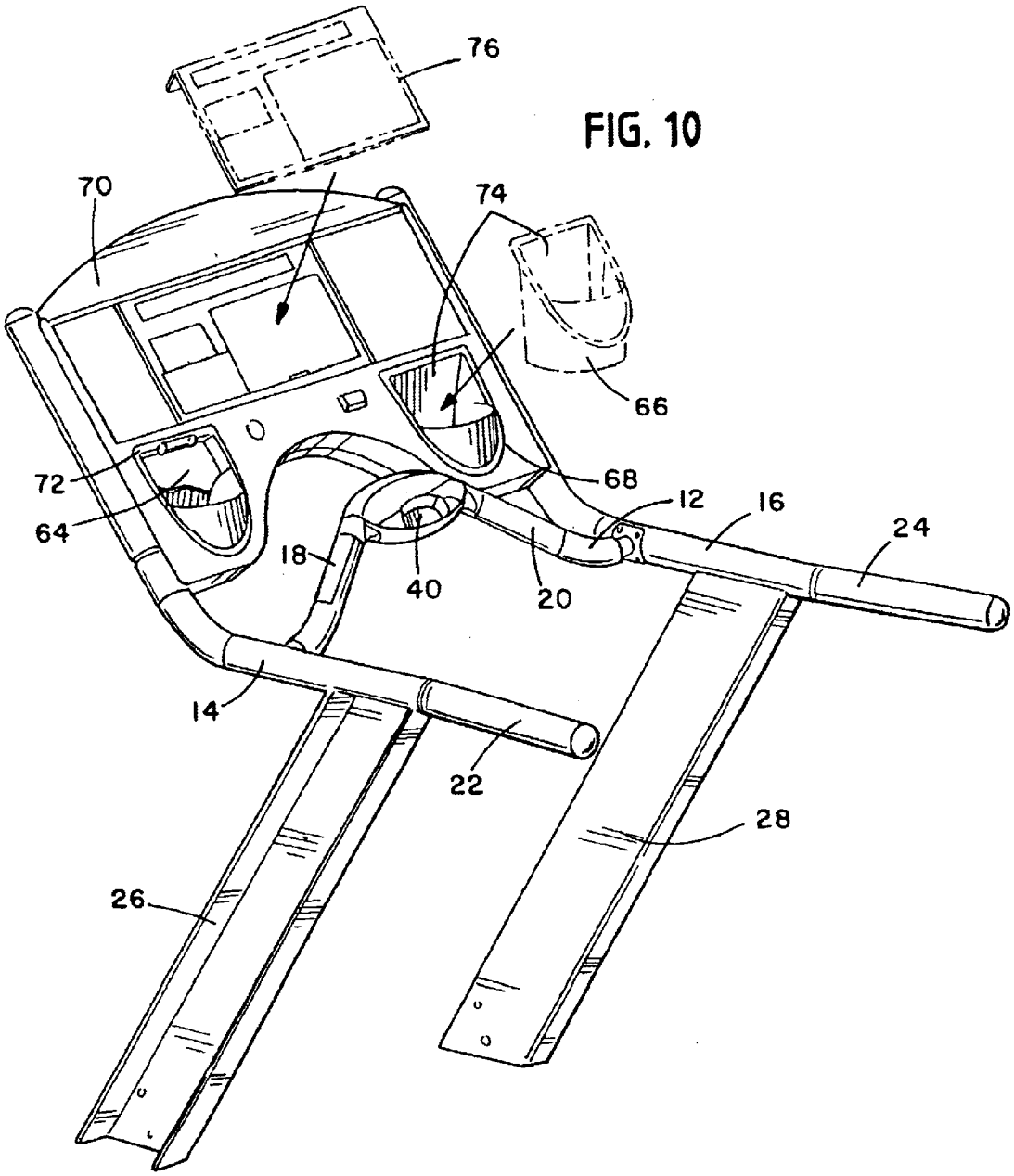
FIG. 10 is a partial, exploded perspective view of the control panel used in the exercise treadmill of FIG. 1 illustrating a pair of snap-in accessory trays and a removable overlay.

FIG. 10 illustrates two other features of the invention. The first feature is a pair of snap-in trays 64 and 66. Because most treadmills use fixed accessory trays, they tend to accumulate dirt, sweat and other fluids in health club environments. By providing the snap-trays 64 and 66 which can be inserted and removed without tools from a receiving portion indicated at 68 in a treadmill user interface or control panel 70, cleaning of the trays 64 and 66 is substantially facilitated. In the preferred embodiment the trays 64 and 66 are configured with lips 72 and 74 for supporting the trays 64 and 66 within the receiving portion 68 on the upper surface of the control panel 70.

The second feature shown in FIG. 10 is a fitted, removable transparent overlay 76 (shown in phantom) which can essentially be removed without tools. Typically the control panel 70 features an electronic keypad (not shown) that in the preferred embodiment is covered by the overlay 76. Since the keypad is subject to considerable wear, utilizing the removable overlay 76 can significantly reduce maintenance costs.

Figure 11A:
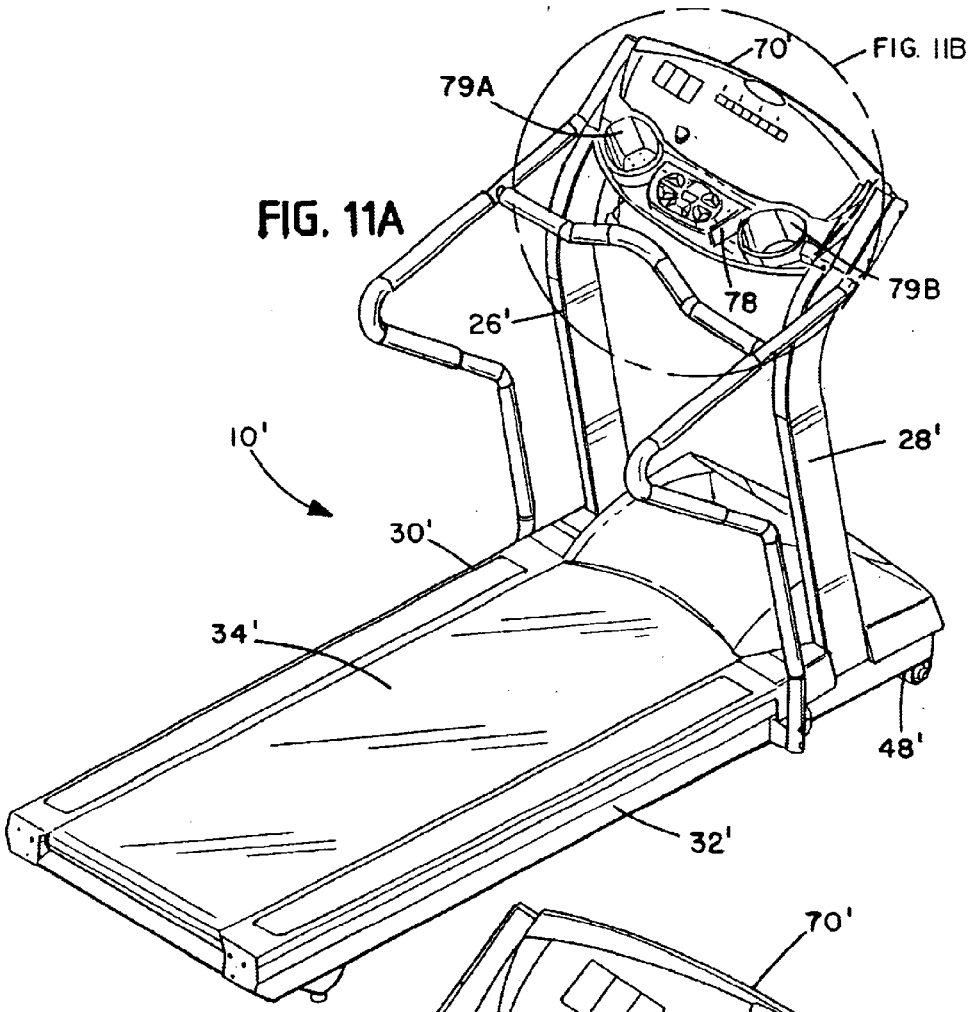
FIG. 11A is a perspective view of an assembled exercise treadmill showing the location of an auxiliary control panel according to the invention.
Figure 11B:
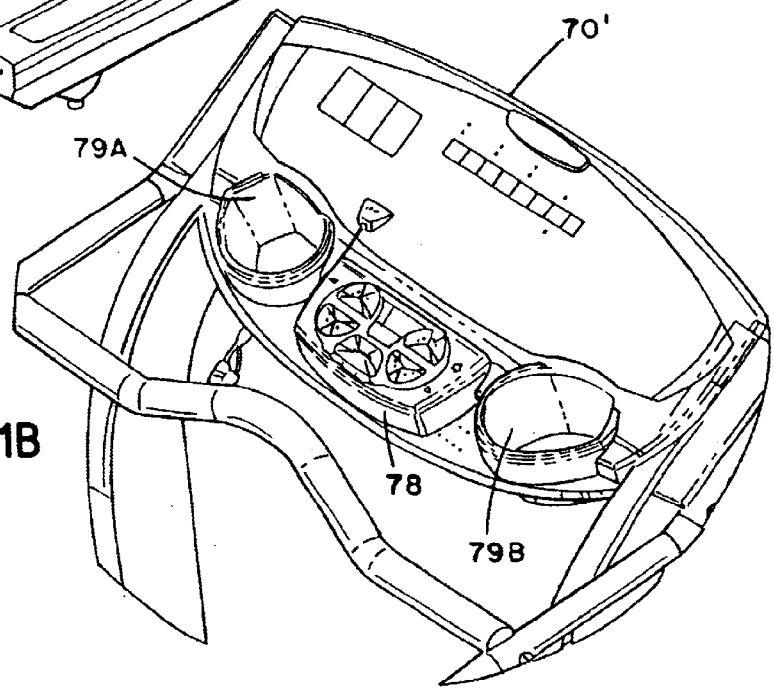
FIG. 11B is an enlarged perspective view of the location of an auxiliary control panel of FIG. 11A.
Figure 12A:
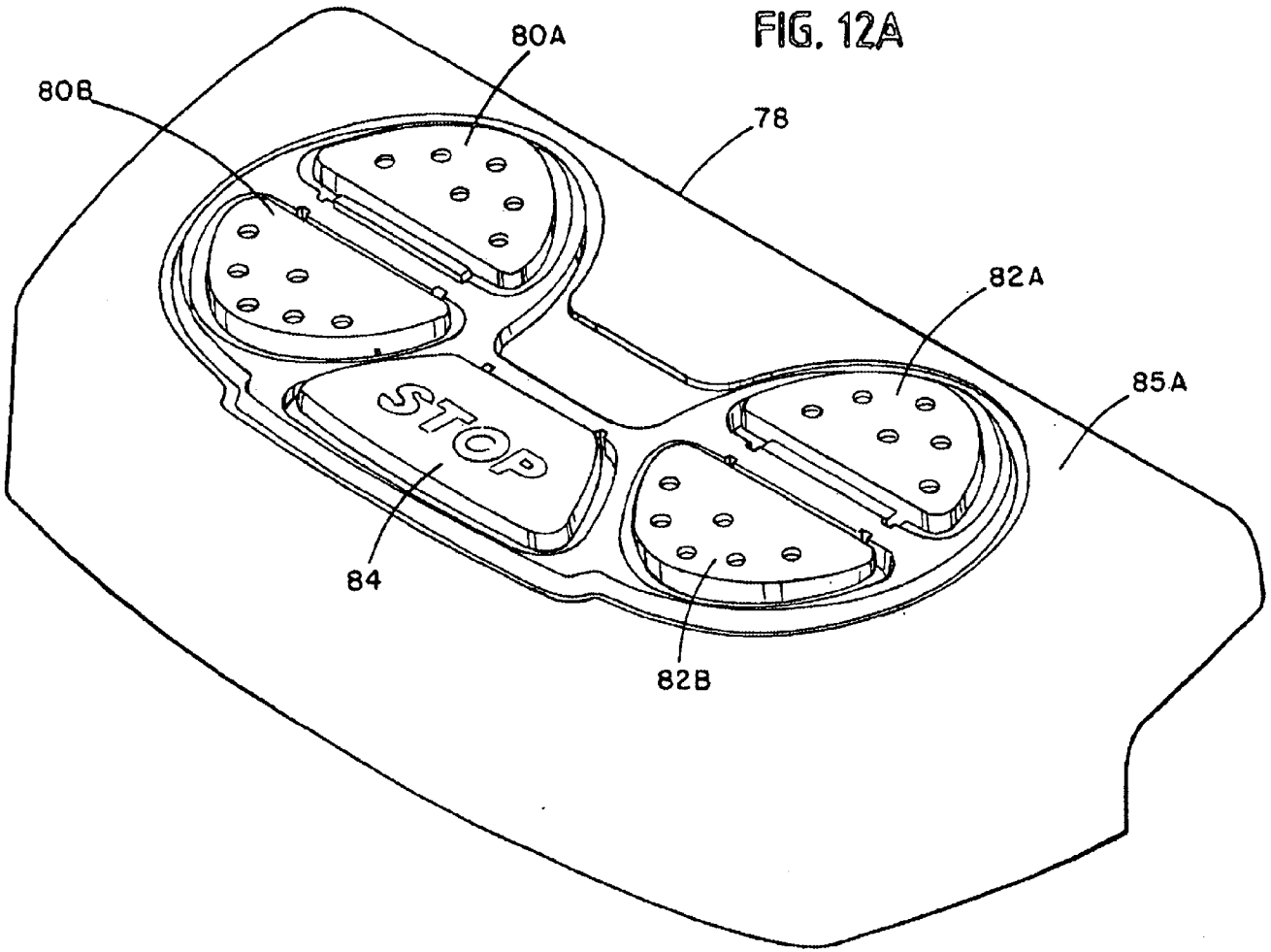
FIG. 12A is a perspective view of an assembled auxiliary control panel of FIGS. 11A–B.
Figure 12B:
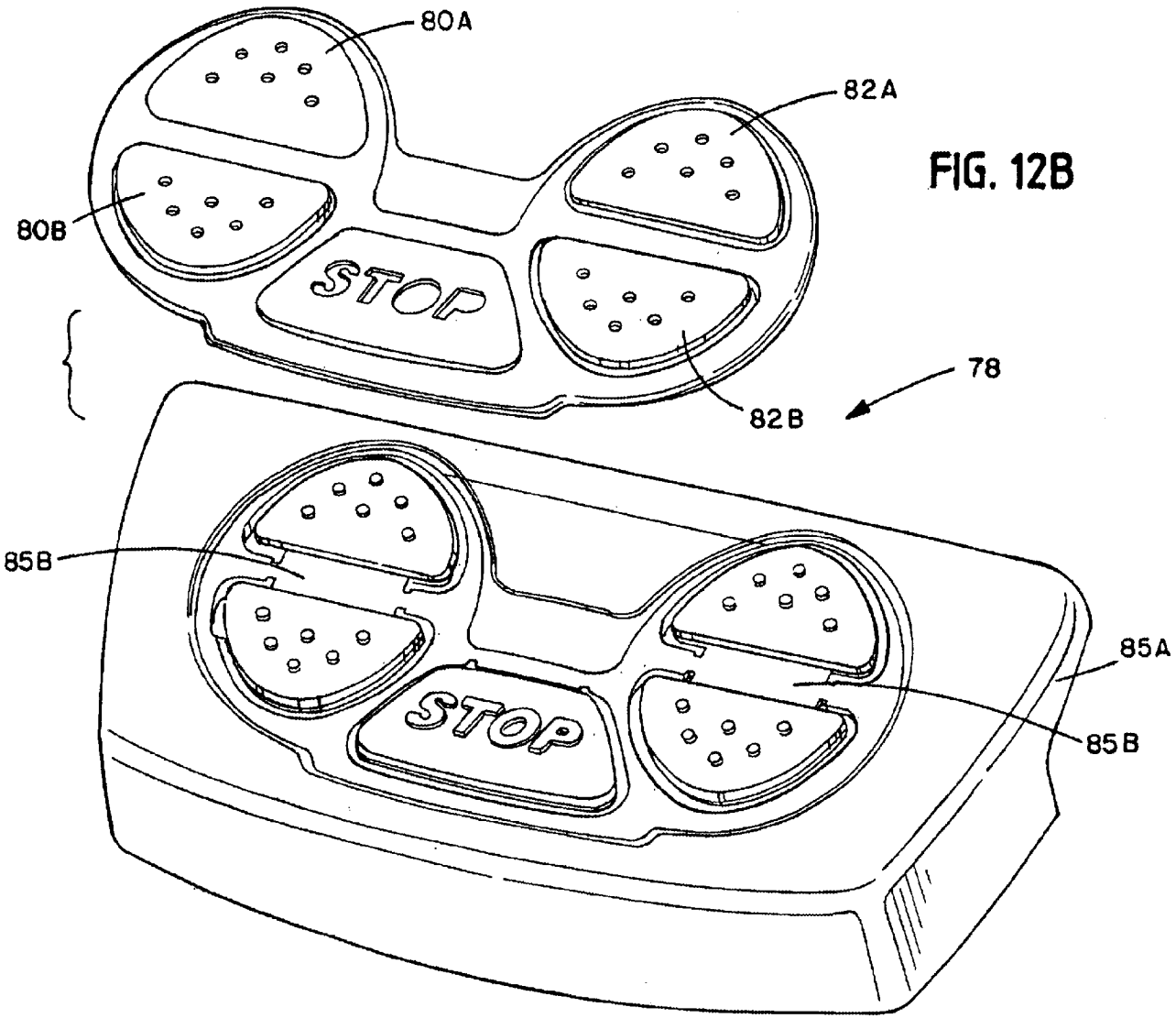
FIG. 12B is an exploded perspective top view of the assembled auxiliary control panel of FIGS. 11A–B.
Figures 12C, 13:
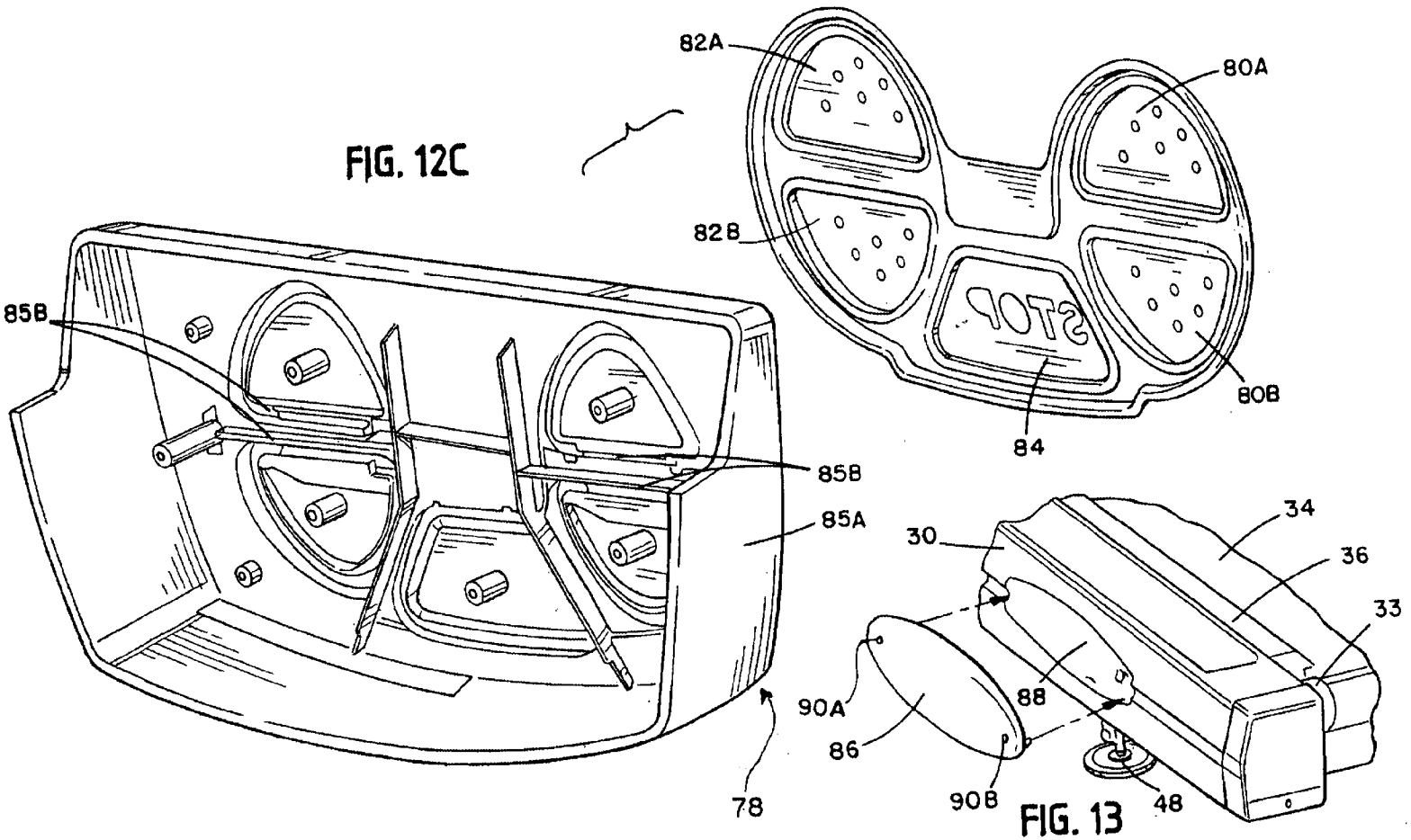
FIG. 12C is an exploded perspective bottom view of the assembled auxiliary control panel of FIGS. 11A–B.
FIG. 13 is a partial, exploded perspective view of the exercise treadmill of FIG. 1 illustrating a removable access panel.

FIGS. 11A–B and 12A–C depict an additional feature of the invention where an auxiliary control panel 78 is utilized in conjunction with a main control panel 70' of another embodiment 10' of a treadmill. In the preferred embodiment of the invention, the auxiliary control panel 78, as shown in FIG. 11A is secured to the lower part of the main control panel 70'. The treadmill 10' is shown in FIG. 11A as having a somewhat different configuration but the essential treadmill elements are the same as the treadmill 10. In this embodiment the auxiliary treadmill 78 is located between a pair of user trays 79A and 79B. Most exercise treadmills have a number of user controls that can include: a keypad speed, incline, start, exercise program, and stop buttons (not shown in FIGS. 11A–B). Preferably the auxiliary control panel 78 has a subset of the user controls on the main control panel 70' and as in the preferred embodiment shown in FIGS. 12A–C these controls can include a set of speed control buttons 80A–B, a set of incline control buttons 82A–B and a stop button 84. In addition, preferably these buttons 80A–B, 82A–B and 84 are larger than the corresponding control buttons on the main control panel 70'. The subset of controls for the auxiliary control panel 78 is preferably selected to provide the user with easily used controls for the most common changes that he is likely to make while running on the treadmill 10'. The preferred construction of the auxiliary control panel 78 as shown in FIGS. 12A–C includes a base of thermoplastic resin 85 and an overmolded thermoplastic elastomer resin made by multi-shot injection molding techniques. The base resin 85A provides a support structure and shape to the part. The control buttons 80A–B, 82A–B and 84 are connected to the auxiliary control panel 78 by a set of living hinges indicated by 85B with designed in bosses opposite each control button 80A–B, 82A–B and 84. When the user deflects one of the buttons 80A–B, 82A–B and 84, the deflection is transmitted through the boss and into a pad of an electrical membrane switch (not shown) located opposite of the boss. The overmolded elastomeric resin provides a soft touch feeling to the user due to its low durometer, rubber like characteristics. The overmolded resin can in addition act as a color separator, functions to seal the gaps between the control buttons 80A–B, 82A–B and 84 and the base resin 85A thus providing a liquid proof barrier to the electronics located beneath the auxiliary control panel 78.

FIG. 13 illustrates another feature of the invention which is the use of one or more access panels such as an access panel shown at 86. In many cases, treadmill parts or systems such as the lubrication system described in Szymczak et al, U.S. Pat. No. 5,433,679, are located between the upper run and the lower run of the treadmill belt 34. Typically structural features, such as the treadmill frame housings 30 and 32, the deck 36 and the belt 34, will limit access to these parts. In some cases the treadmill 10 might have to be substantially disassembled to service such systems. By providing the access panel(s) 86 to cover an opening 88 in the housings 30 and 32, serviceable parts and systems can be easily reached, viewed and serviced without disassembling, relocating or turning the treadmill 10 over. The access panel(s) 86 can be secured to the housings 30 and 32 by a set of fasteners 90A and 90B, screws, bolts or clips for example, to provide ready access to the components of the treadmill 10. This will result in: improved serviceability; greater likelihood of service being performed; and reduced maintenance costs. It should be noted that the access panel (s) 86, as shown in FIGS. 1, 2, 8 and 9 can be located in different portions of the treadmill housings 30 and 32 depending upon the location in the treadmill 10 of the systems to be serviced.

Figure 14:
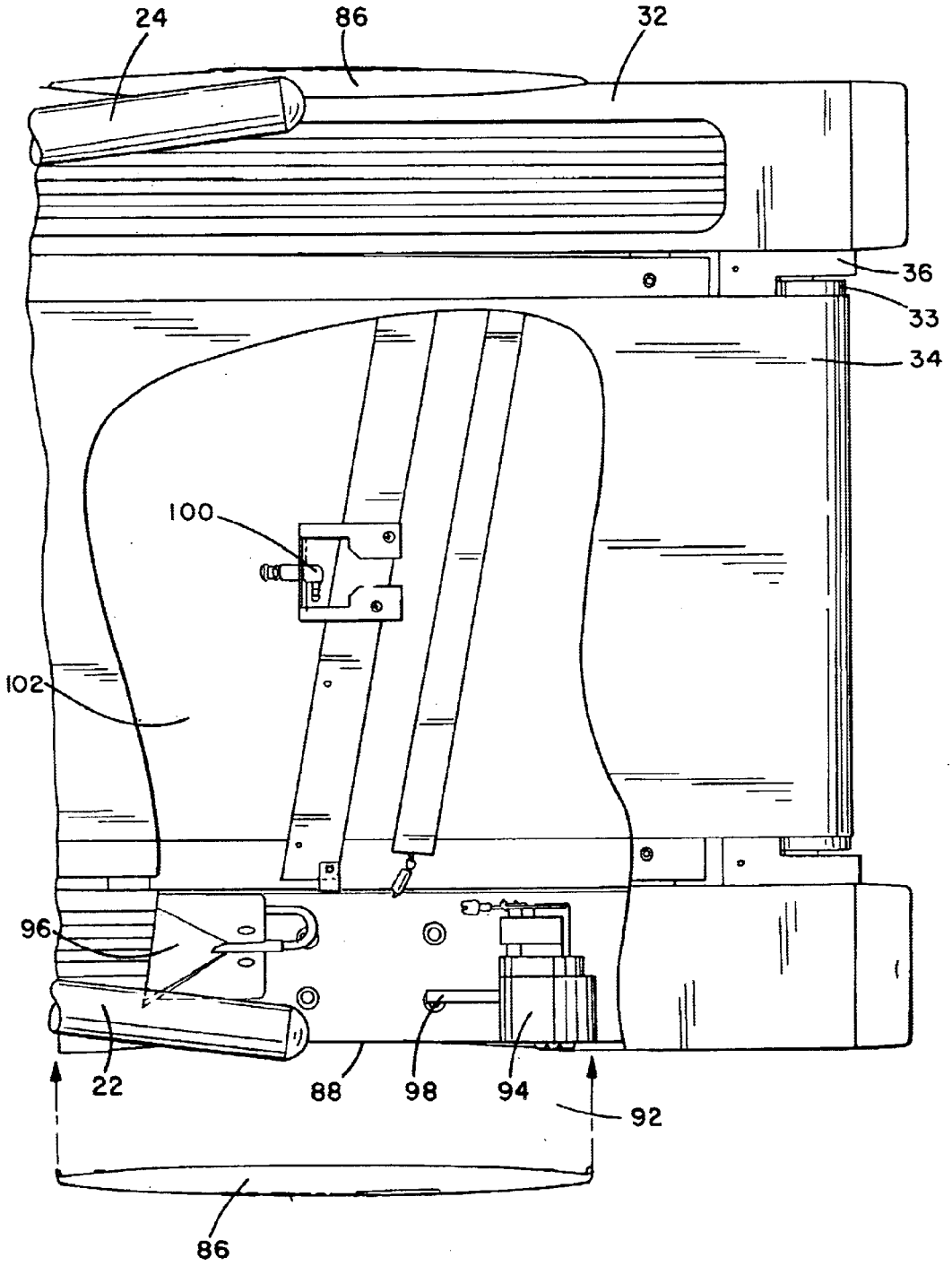
FIG. 14 is a partial, broken away, top plan view of the treadmill of FIGS. 1 and 2 showing a belt lubrication mechanism.

FIG. 14 depicts an example of a treadmill belt lubrication system 92 of the type described in U.S. Pat. No. 5,433,679. In this lubrication system 92, a pump 94 obtains a lubricant from a reservoir 96 via a line 98 and applies it through another line (not shown) to a spray nozzle 100. The nozzle 100 will periodically spray the lubricant, preferably a paraffin wax solution, on the inner surface 102 of the lower run of the belt 34 in order to apply the lubricant to the deck 36. In the preferred embodiment, the composition of the lubricant is 0.6% paraffin wax, 0.9% emulsifiers and 98.5% water by weight and the nozzle 100 sprays an 11.5 inch width of the lubricant on the surface 102. However, it has been found that after each spray of the lubricant a hardened residue of wax and the emulsifier tends to remain on the orifice of the nozzle 100. This residue can alter the spray characteristics of the nozzle 100 and in some instances block its orifice altogether. One approach to solving this problem is to heat the nozzle 100 but cost, safety concerns and electrical system considerations tend to make this solution impractical. In the preferred embodiment of the invention, a short, preferably 0.5 to 2.0 second, priming pulse of the lubricant is pumped by the pump 94 through the nozzle 100 prior to initiating the regular belt lubrication spray. It is believed that the priming pulse acts to clear the orifice of the nozzle 100 by having the emulsifier in the priming pulse emulsify the wax residue and in combination with emulsifier acts to soften the residue so the regular spray through the nozzle 100 can clear the orifice. The period between the priming pulse and the regular pulse is preferably on the order of 5 minutes in order to give the residue sufficient time to soften. The use of a priming pulse in a treadmill lubrication system of the type indicated at 92 has a number of advantages. For example, the cost of implementing this process is very low since it only requires a minor change to the software controlling which controls the lubrication system 92. Also, because this process is essentially a self-cleaning process, the nozzle 100 will not clog regardless of how many times lubricant is sprayed. It should be noted that the spray times described above are based on the characteristics of the nozzle 100 and the lubricant discussed above and modifications of these times might be desirable based on the use of different lubricants or nozzle configurations. In the preferred embodiment, the lubrication system 92 including the priming pulse can be implemented using the control system 234 as described in connection with FIG. 27 below.

FIG. 15 along with FIG. 16 illustrate a further feature of the invention. In order to reduce cost and weight in treadmills, injection molded plastic parts are often used in various parts of the treadmill. However, some of the parts, such as the control panel 70, require rib sections having a high degree of structural strength. The desired structural characteristics have been accomplished in some treadmills by reenforcing the ribs with metal parts or molding the parts with tall or thick rib sections. However, using injection molding to form these types of rib sections typically results in poor aesthetics such as sink marks or poor part moldability. By utilizing a gas assist injection molding process, sound structural features can readily be designed into the part without introducing sink marks along with increasing the moldability of the part, that is, increasing the yield and reducing short shots. An example of such a gas assisted injected molded rib section is shown in FIG. 15. In this example, a rib section 104 of the part to be molded having, for instance a height of 1½" and a thickness of ⅛", is formed from the material in a base portion 106, which is approximately ⅛" thick. This rib 104 can be used in an upper control panel housing 108 of the control panel 70. The gas assist injection molding process will cause a void 110 due to the injection of a gas into the cavity 110 resulting in the surface 112 under the void 110 having a smooth surface. Gas assist injection molding process equipment can be obtained from Cinpress and Alliance Gas Systems and the process can be performed by Victor Plastics of Victor, Iowa. A specific example of such molded ribs 104 in the control panel housing 108 is shown in FIG. 16 where a set of longitudinal support ribs 104A–F are formed by the gas assist injection molding process. These ribs 104A–F provide the primary longitudinal support for the control panel 70 and by using these types of support ribs, the making of larger panels that are less subject to vibration from the treadmill 10 is facilitated. In addition, the housing 108 includes a set of lateral support ribs 114A–B that serve to strengthen the upper portion of the housing 108. Also shown in FIG. 16 are a number of gas pin nozzles 116A–D that are used to inject gas into the ribs 104A–F and 114A–B.

Figure 17:
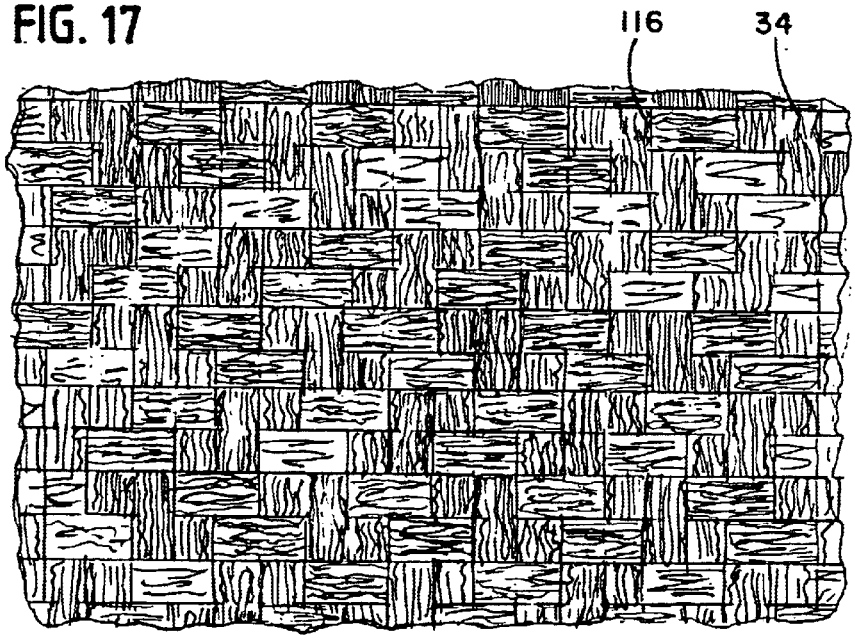
FIG. 17 is an illustration of a woven belt having a glazed surface for use with the treadmills of FIGS. 1 and 11.

FIG. 17 provides an illustration of another feature of the invention where the treadmill belt 34 has a pre-glazed surface. Most treadmill belts are composed of woven polyester or polyurethane fabric bound to a PVC or polyurethane outer layer by a binder of a similar material. Typically the fabric is composed of bundles of filament approximately 20 μm in diameter and the bundles are woven into either a plain weave or a twill weave as shown in FIG. 17. It is an inner surface 116 of the belt 70 that contacts the deck 34 where frictional loads are developed as the user walks or runs on the belt 70. It has been found that by pre-glazing the surface 116 of the belt 70, the frictional interface between the deck 34 and the belt 70 can be stabilized and improved. Glazing is the process whereby the woven fabric on the surface 116 is transformed from individual filament stands into a smooth, molten surface via melting and re-setting. The preferred method of pre-glazing the surface 116 is by calendering where the fabric is pressed between rollers under heat without actually melting the fibers. Other methods of pre-glazing can include: ironing the fabric to melt the top layer of fibers into a smooth surface; melting the top layer of the fabric using infrared heat or a laser; coating the fabric with a material to fill in the voids in the surface of the fabric using for example a wax, teflon or silicone; and chemically glazing the fabric using a chemical compound or solvent sprayed on to the fabric to etch or adhere the fibers together.

Figure 18:
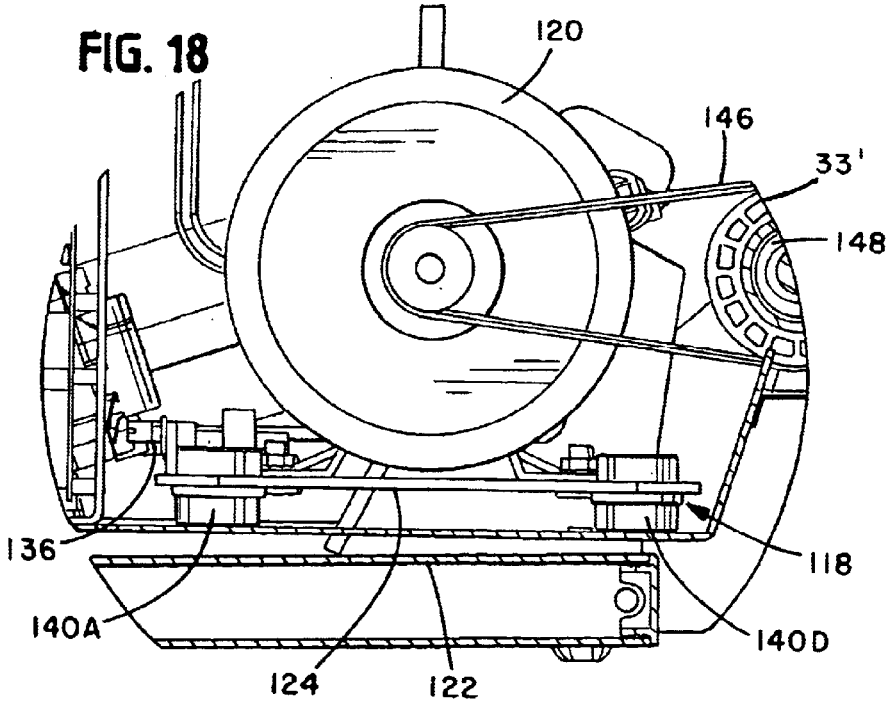
FIG. 18 is a sectioned, partial side view of a treadmill of the type in FIG. 11 having a first embodiment of a motor isolation mount according to the invention.
Figure 19:
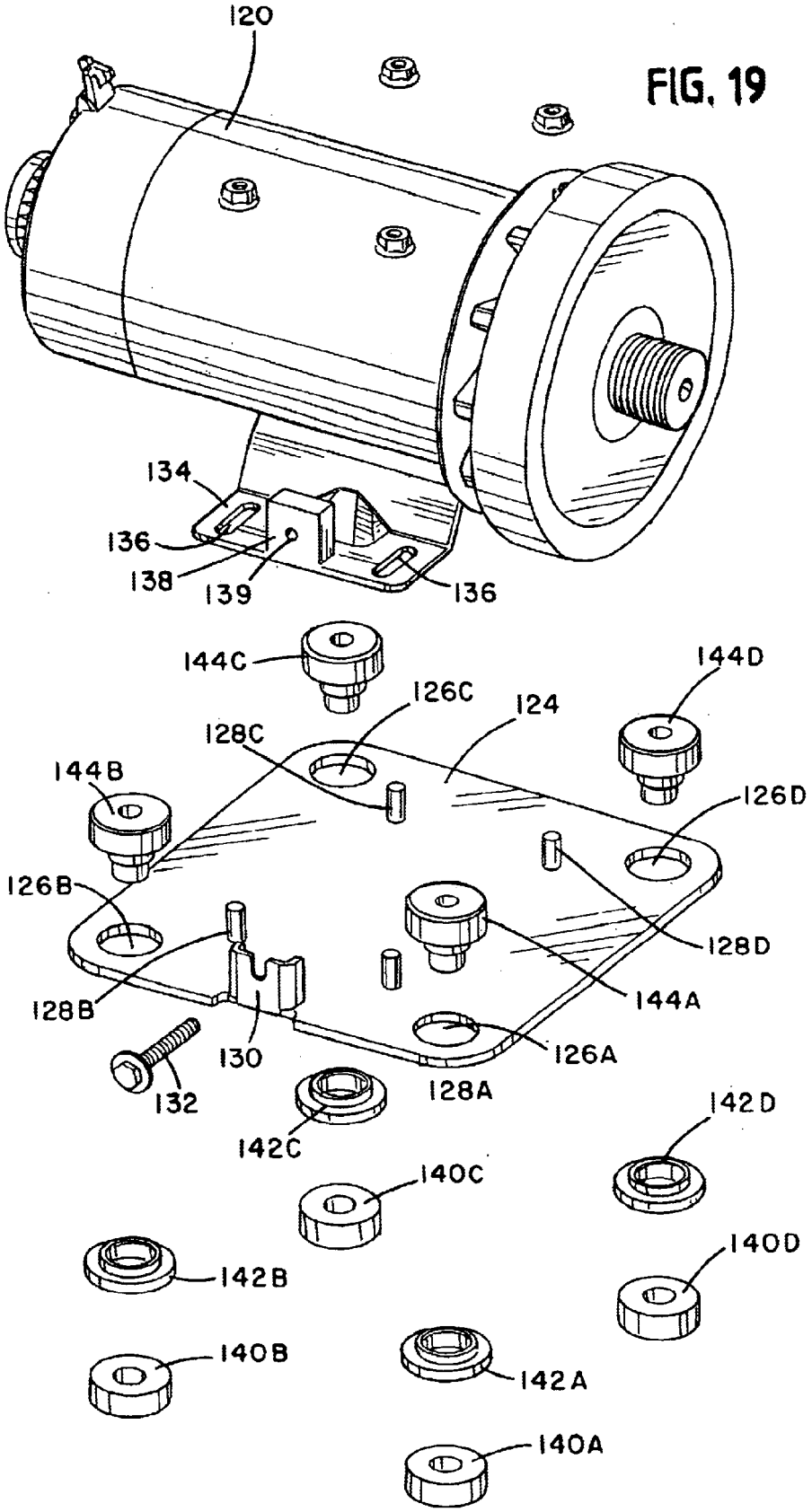
FIG. 19 is an exploded perspective view of the motor isolation mount of FIG. 18.

FIGS. 18, 19 and 20 provide a depiction of the preferred embodiment of a motor isolation mount 118 for the treadmill 10'. Corresponding components of the treadmill 10' to the treadmill shown in FIGS. 1 and 2 are indicated with primed reference numerals. In this embodiment of the invention a motor 120 is secured to a motor support element 122 on the treadmill 10' frame by the motor isolation mount 118. The motor isolation mount includes a mounting plate 124 having four circular openings 126A–D, a set of four studs 128A–D, and an adjustment bracket 130 for receiving a threaded adjustment member 132. The threaded adjustment member 132 can be a bolt or a screw. Attached to the motor 120 is a motor bracket 134 configured with four longitudinal slots indicated by reference numeral 136 and a adjustment block 138 having a tapped receptacle 139 for receiving said adjustment bolt. Secured between the motor support element 122 and the mounting plate 124 are a set of four resilient members 140A–D, which are preferably composed of natural rubber having a durometer of about 50. A set of plastic collars 142A–D extend through the openings 126A–D and abut the resilient members 140A–D. A second set of resilient members 144A–D located on the top surface of the mounting plate 124 is fastened to each of the first set of resilient members 140A–D and to the motor support element 122 by a fastener or other suitable methods in order to secure the motor 120 to the motor support element 124. Tension on a pulley drive belt 146 which serves to connect a belt pulley 148 to the motor 120 as shown in FIG. 18 can be adjusted by turning said adjustment bolt so as to cause said motor bracket 136 to move linearly as guided by said studs 128A–D in a longitudinal direction. Thus, the motor isolation mount 118 can be effective to both isolate the treadmill frame from motor isolation and to be used to conveniently adjust the tension on said drive belt 146.

Figure 22:
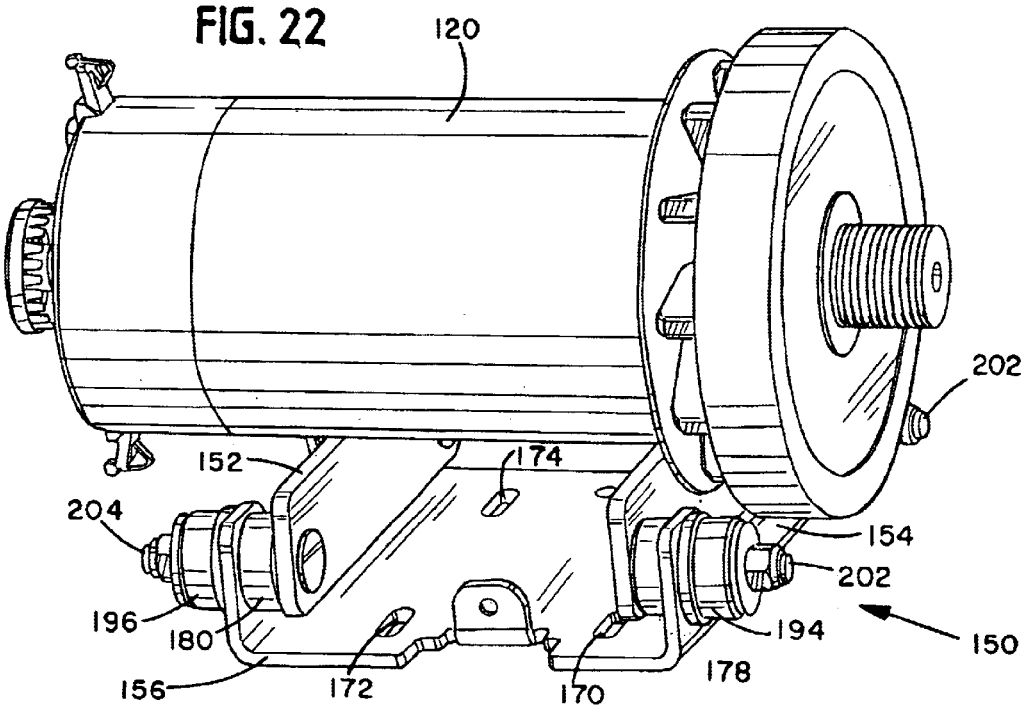
FIG. 22 is an assembled perspective view of the second embodiment of a motor isolation mount of FIG. 21.

FIGS. 21 and 22 illustrate a second embodiment of a motor isolation mount 150 for use with the treadmill 10'. In this embodiment a pair of mounting brackets 152 and 154 are welded, fastened or otherwise secured to the motor 120. A mounting plate 156 having a pair of flanges 158 and 160 each configured with a pair of circular openings 162, 164, 166 and 168 along with having a set of four longitudinally configured slots 170, 172, 174 and 176 is mounted on the motor support element 124 by fasteners such as bolts or screws (not shown). Secured between the mounting brackets 152 and 154 is a first set of isolation members 178, 180, 182 and 184 each having a circular resilient portion preferably configured from natural rubber. The isolation members 178, 180, 182 and 184 also include an extension portion indicated at 186, 188, 190 and 192 that extend through the openings 162, 164, 166 and 168 in the flanges 158 and 160. A second set of circular rubber members 194, 196, 198 and 200 are secured on the other side of the flanges 158 and 160 and the isolation members 178, 180, 182 and 184 by a set of fastening members, as represented by the reference numerals 202 and 204.

Figure 23:
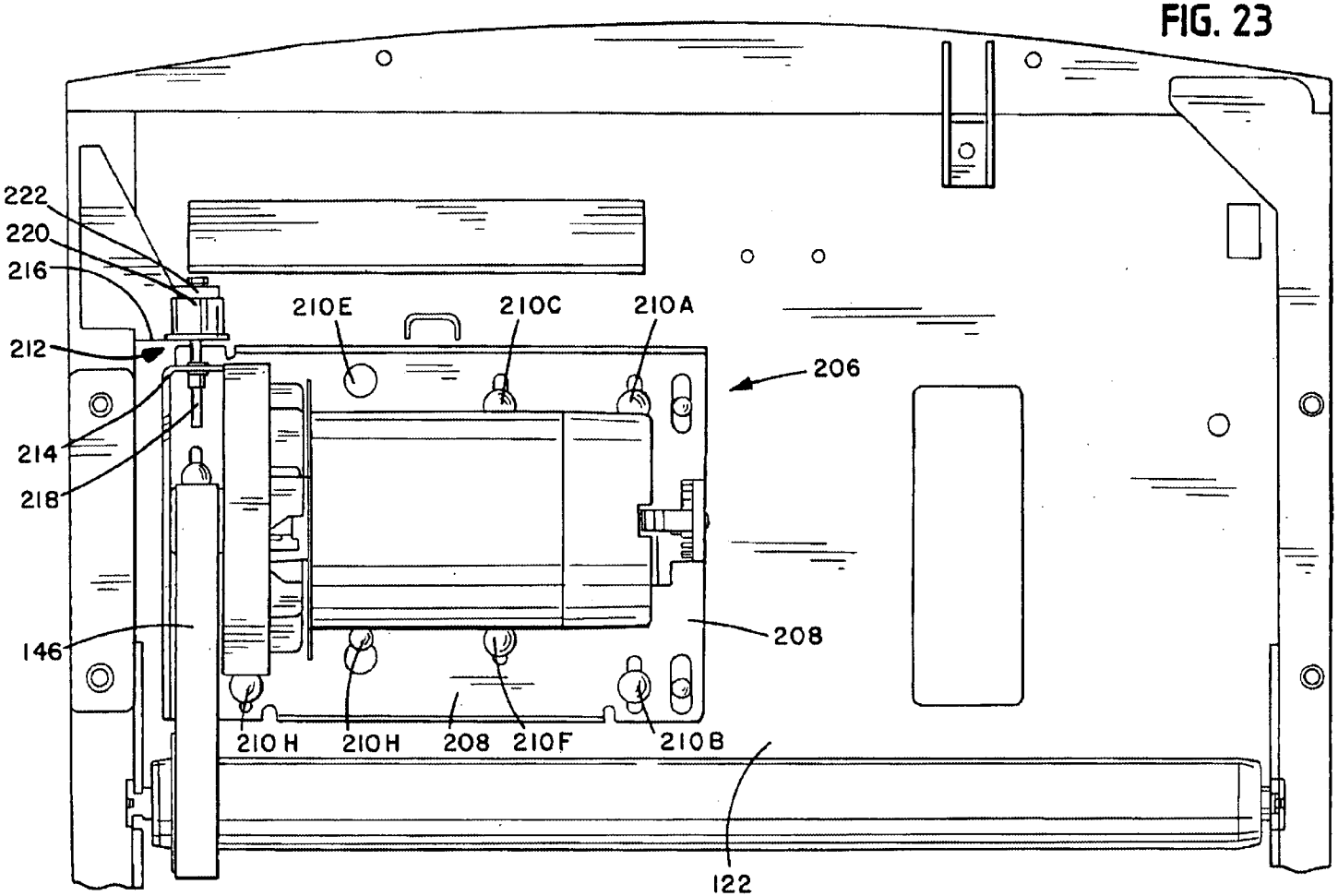
FIG. 23 is a top view of a third embodiment of a motor isolation mount.
Figure 24:
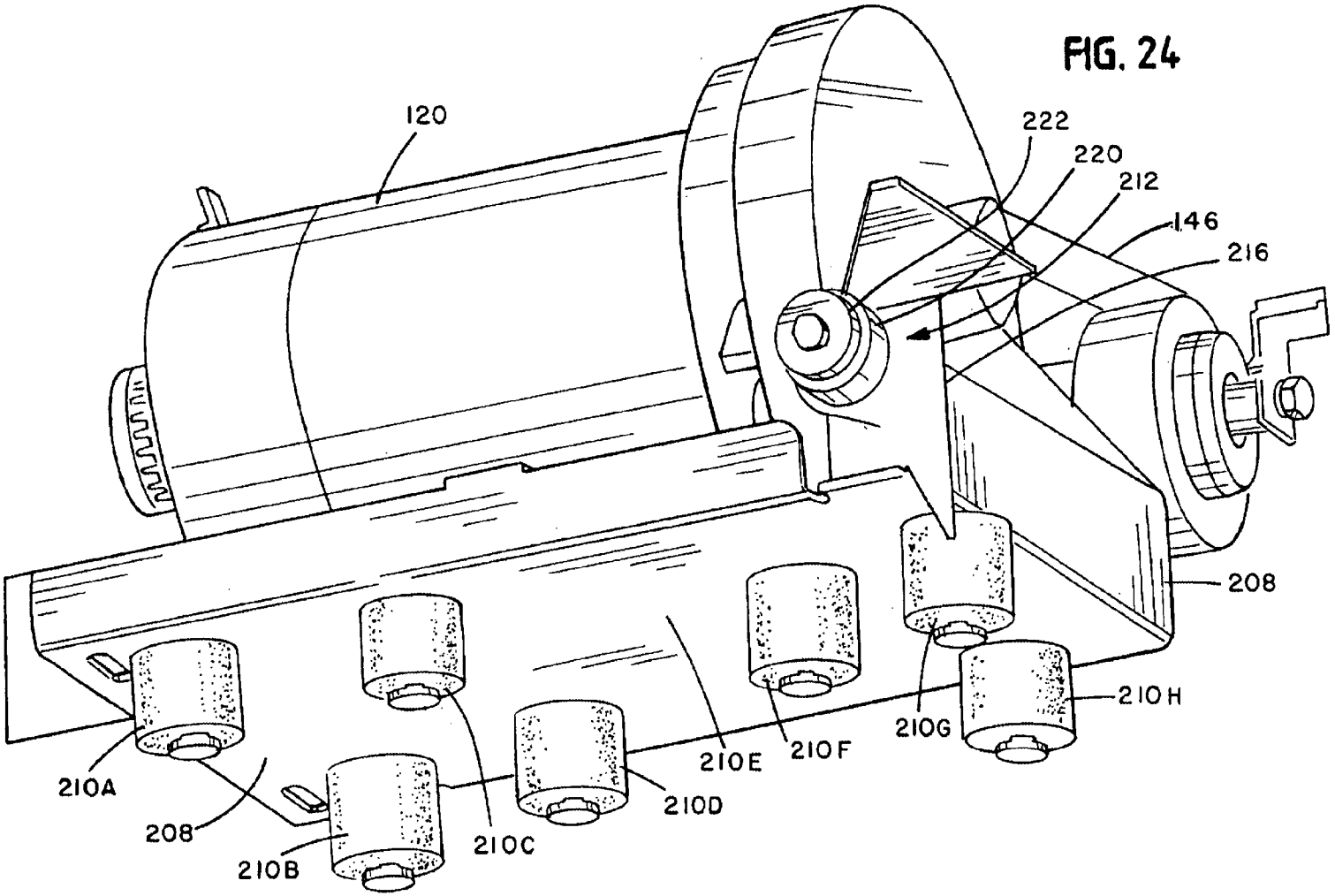
FIG. 24 is a bottom perspective view of the third embodiment of a motor isolation mount of FIG. 23.
Figure 25:
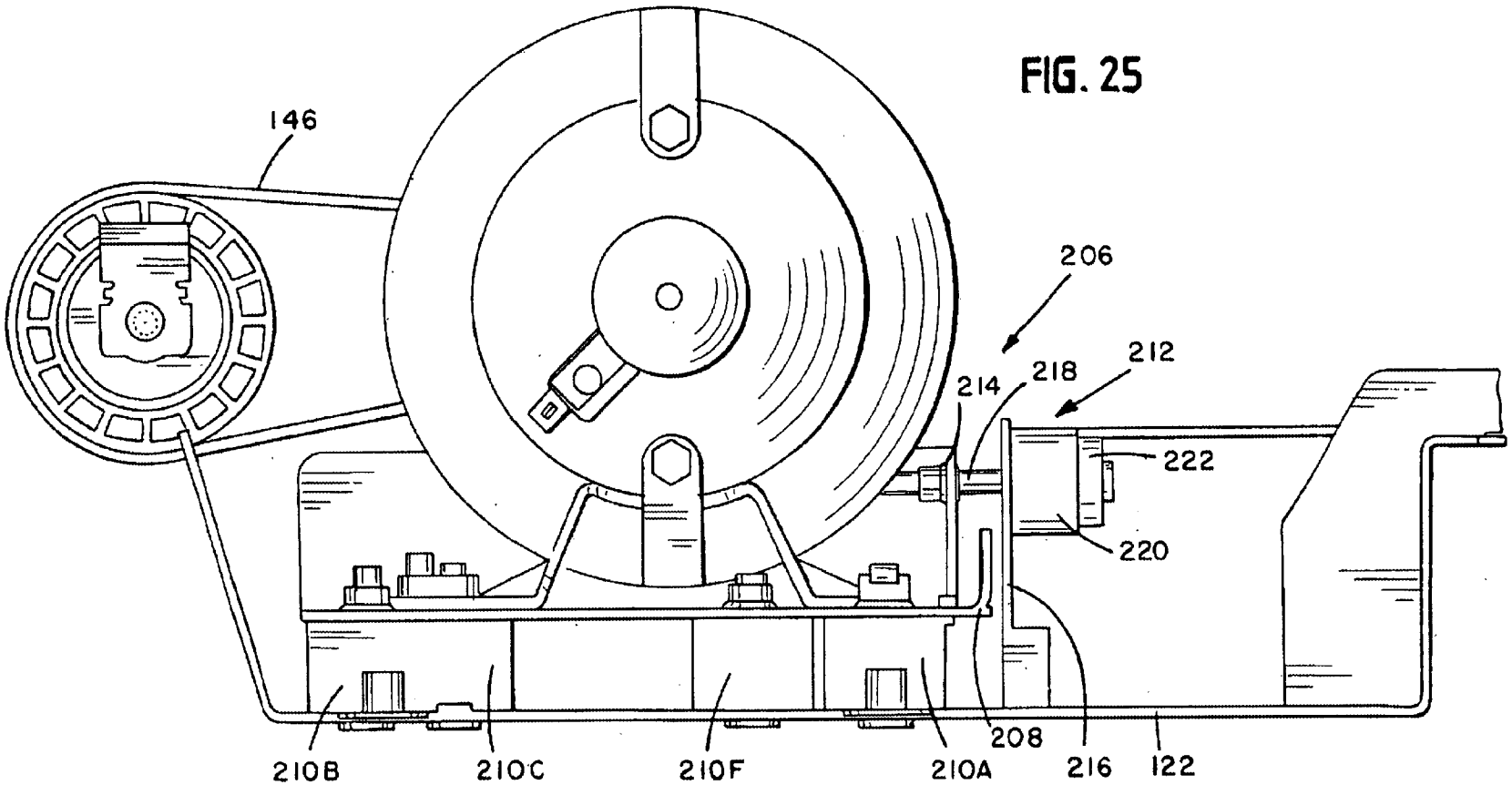
FIG. 25 is a side view of the third embodiment of the motor isolation mount of FIG. 23.

FIGS. 23, 24 and 25 show a third embodiment of a motor isolation mount 206 for use with the treadmill 10'. In this arrangement 206, a mounting plate 208 is secured to the motor support element 122 by a set of at least eight resilient members 210A–H which preferably are rubber sandwich mounts having a male thread on one end and a female thread on the other end and having a durometer of 50 shore A. Suitable rubber sandwich mounts of natural rubber or neoprene can be obtained from a number of commercial sources including the McMaster-Carr company. The motor isolation mount 206 also includes a belt tensioning mechanism 212 for applying the appropriate tension to the drive belt 146. Included in the tensioning mechanism 212 is a first bracket 214 secured to the mounting plate 208 and a second bracket 216 attached to said motor support member 122 with a belt tensioning screw 218 engaged with each of the brackets 212 and 214. The tensioning screw 218 is effective to move the motor 120 in a longitudinal direction to tension the drive belt 146. In the preferred embodiment of the motor isolation mount 206, the second bracket 216 includes a circular tensioning bracket 220 having a cylindrical rubber sleeve 222 through which the tensioning screw extends 218. Also, as can be seen from FIG. 25, the tensioning mechanism 212 is longitudinally aligned with the drive belt 146.

Figure 26:
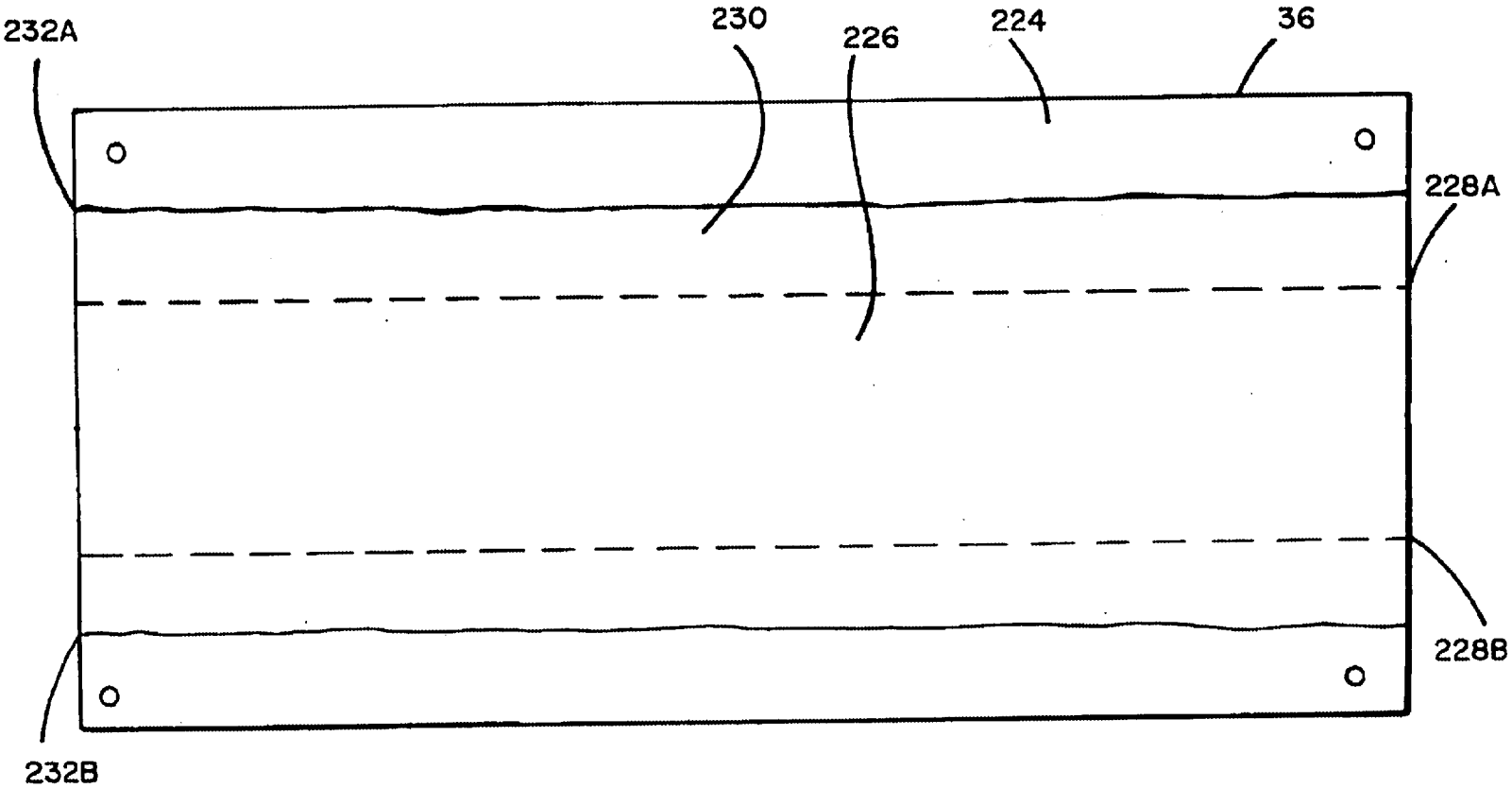
FIG. 26 is a plan view of an underside of a double sided treadmill deck according to the invention.

FIG. 26 provides a bottom view of a double sided treadmill deck 36' for use with the treadmill 10' of FIG. 18. A double sided treadmill deck is a deck where the sides can be reversed or flipped over when one side becomes worn due to wear from the belt 34'. Both sides of the deck have a lubricant such as a wax coating impregnated on the deck surfaces to reduce friction as the belt 34' moves over the deck surface. As shown in FIG. 26, a bottom side 224 of the deck 36' has a waxed area 226 located between dashed lines 228A–B. In order to protect the waxed area 226 from contamination with dirt or other substances when the deck 34' is installed with the top side of the deck being used to support the belt 34', a protective coating or tape 230 is applied to the bottom side 224 over the waxed area 226. Preferably, the tape 230 will extend the length of the deck 10' and beyond the lateral sides of the waxed area 226 as indicated by a pair lines 232A–B, The lateral extension of the tape 230 past the waxed area 226 is desirable in order to provide a non-waxed area surface on the deck 10' to which the tape 230 can adhere. To prepare the lower surface 224 of the deck 10' for use, the tape 230 is simply peeled away from the surface 224. Preferably, the protective tape 230 should be self-adhering while not leaving any residue on the surface 224 when it is removed. Also, the tape 230 preferably should not remove any of the wax 226 from the surface 224 when it is removed. A suitable protective tape is a co-extruded polyethylene tape that is available from the 3M Industrial Tape and Specialties Division under part numbers 25A87-25A88.

Figure 27:
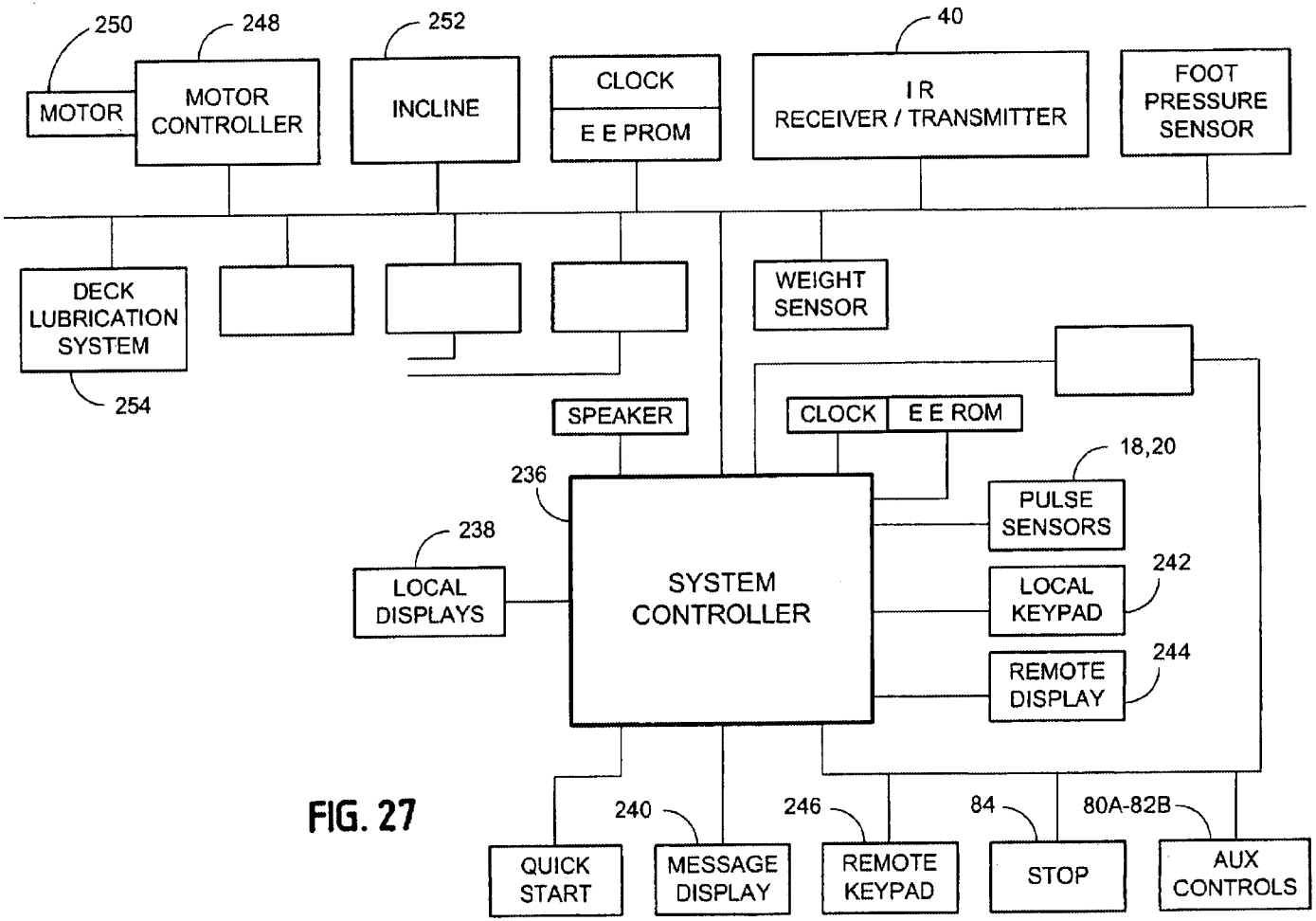
FIG. 27 is a block diagram of the control system suitable for use with the treadmills of FIGS. 1–25.

FIG. 27 is a representative block diagram of a control system 234 suitable for use with the treadmills 10 and 10'. The control system 234 is generally similar to many commercial exercise treadmill control systems including the one shown in FIG. 16 of U.S. Pat. No. 5,752,897 which uses an AC motor to propel the belt 34. A microprocessor based system controller 236 is used to control a local display 238, a message display 240 and a keypad 242 on the control panel 70 along with an optional remote display 244, a remote keypad 246, the auxiliary stop control 84, the infrared receiver 40 and the auxiliary treadmill controls 80A–B and 82A–B discussed in connection with FIGS. 11A–B. In addition the control system 234 in the treadmill 10 serves to control a motor controller 248, that in turn controls an AC motor 250 which drives the treadmill belt 34 via pulleys (not shown), and a treadmill incline controller 252 that controls the incline mechanism as discussed above in connection with FIGS. 8A–B as well as other components of the control system 234 shown in FIG. 27. The control system 234 can also include a belt lubrication control 254 to control the belt lubrication system 92 and can be programed to implement the priming pulse described in connection with FIG. 14.

It should be noted that the various features described above have been described in terms of their preferred embodiments in the context of the particular treadmills 10 and 10' disclosed herein. The manner in which these features can be implemented will depend upon a number of factors including the nature of the treadmill, the nature of its use and the materials used for its construction. For example, there are many different types of lubrication systems, inclination mechanisms, mechanical arrangements, resilient members, fasteners, materials and components that would be suitable for implementing the various features described herein including the motor isolation mounts that would be functionally equivalent to the preferred embodiments as well as within the scope of this invention.

We claim:

1. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated; and a control system operatively connected to said motor and said inclination mechanism;

an inclination mechanism secured to a first end of said frame structure effective to permit selective inclination of said frame structure by a user; and a control panel secured to said frame structure and operatively connected to said motor and said inclination mechanism having wherein said control panel includes a lower housing member formed out of a molded plastic having a base portion and a plurality of support ribs integral with said base portion and configured with internal apertures extending at least a substantial portion of the length of said support ribs.

2. The exercise treadmill of claim 1 wherein said apertures are formed by a gas assist injection molding process.

3. The exercise treadmill of claim 1 wherein at least a portion of said support ribs extend in a longitudinal direction.

4. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a deck member secured to said frame;

a belt secured over said pulleys so as to move in a longitudinal direction over said deck member when said first pulley is rotated wherein said belt is a woven material and wherein the surface of said belt abutting said deck member is pre-glazed; and a control panel secured to said frame structure and operatively connected to said motor wherein said control panel permits a user to control the speed of said belt.

5. The exercise treadmill of claim 4 wherein said belt material is selected from the group of polyester or polyurethane and said pre-glazing results from a heated surface applied to said surface.

6. The exercise treadmill of claim 4 wherein said belt material is selected from the group of polyester or polyurethane and said pre-glazing results from calendering said material.

7. The exercise treadmill of claim 4 wherein said belt material is selected from the group of polyester or polyurethane and said pre-glazing results from heating said surface sufficiently to melt the woven fibers.

8. An exercise treadmill, comprising:

a frame structure including two rotatable pulleys, said pulleys being positioned substantially parallel to each other, a pair of spaced apart longitudinal frame members for providing longitudinal structural support for said frame structure, and a motor support member:

a motor for rotating a first one of said pulleys;

a motor mounting structure for securing said motor to said motor support member including a plurality of resilient members effective to isolate said frame structure from the vibration of said motor wherein said motor mounting structure includes a mounting plate secured to said motor and said motor support member and a first set of said resilient members secured between said mounting plate and said motor support member;

a deck member secured to said frame;

a belt secured over said pulleys so as to move in a longitudinal direction over said deck member when said first pulley is rotated; and a control panel secured to said frame structure and operatively connected to said motor wherein said control panel permits a user to control the seed of said belt.

9. The exercise treadmill of claim 8 wherein said motor support structure includes a second set of said resilient support members secured between said mounting plate and said motor.

10. The exercise treadmill of claim 8 wherein said motor is connected to said first pulley by a flexible member and said motor support structure includes a tensioning mechanism for tensioning said flexible member.

11. The exercise treadmill of claim 10 wherein said tensioning mechanism includes a plurality of studs secured to said mounting plate, a motor bracket secured to said motor configured with a plurality of elongated slots engaged with said studs for permitting limited longitudinal movement of said motor, and a plurality of fasting members for securing said motor bracket to said studs.

12. The exercise treadmill of claim 11 wherein said tensioning mechanism includes an adjustment mechanism having an adjustment member connected to said motor bracket and said mounting plate effective to move said motor bracket in a longitudinal direction with respect to said mounting plate.

13. The exercise treadmill of claim 11 wherein said adjustment member is a bolt and said motor bracket includes a threaded housing to receive said bolt and said mounting plate includes an adjustment bracket having an aperture through which said bolt is engaged.

14. The exercise treadmill of claim 13 wherein said motor support structure includes a second set of said resilient support members secured between said mounting plate and said motor.

15. The exercise treadmill of claim 8 wherein said motor mounting structure includes a pair of spaced apart mounting brackets secured to said motor, said mounting plate, including a pair of upwardly extending flanges, secured to said motor support member and a set of fasteners connecting said flanges to said mounting brackets wherein a first set of said resilient members is secured between said brackets and said flanges.

16. The exercise treadmill of claim 15 wherein said fasteners are threaded bolts having a nut at one end and said motor support structure includes a second set of said resilient support members secured between said flanges and said nuts.

17. The exercise treadmill of claim 15 wherein said mounting plate is configured with a plurality of elongated slots engaged with a plurality of fastening members for securing said mounting plate to said motor support member and for permitting limited longitudinal movement of said motor.

18. The exercise treadmill of claim 8 wherein said motor mounting structure includes said mounting plate secured to said motor and said motor support member and said resilient members are secured between said mounting plate and said motor support member.

19. The exercise treadmill of claim 18 wherein said resilient members are rubber sandwich mounts.

20. The exercise treadmill of claim 18 wherein said motor is connected to said first pulley by a flexible member and said motor support structure includes a tensioning mechanism for tensioning said flexible member.

21. The exercise treadmill of claim 10 wherein said tensioning mechanism includes a first bracket secured to said mounting plate, a second bracket secured to said motor support member and a tensioning member operatively connected to said first bracket and said second bracket effective to move said motor in a longitudinal direction.

22. The exercise treadmill of claim 21 wherein said tensioning member is aligned with said belt.

23. The exercise treadmill of claim 22 wherein said tensioning mechanism includes a circular tensioning bracket secured to said first bracket and wherein said tensioning member is a screw engaged with both said second bracket and said tensioning bracket.

24. The exercise treadmill of claim 23 wherein said tensioning mechanism includes a circular resilient member, having a central aperture through which said screw extends, mounted in said tensioning bracket.

25. An exercise treadmill, comprising:

a frame structure including two rotatable pulleys, said pulleys being positioned substantially parallel to each other, a pair of spaced apart longitudinal frame members for providing longitudinal structural support for said frame structure, and a motor support member;

a motor for rotating a first one of said pulleys;

a reversible double sided deck member, having a lubricant impregnated on both sides of said deck member, secured to said frame and wherein at least a portion of a first side of said deck member is covered with a removable protective coating;

a belt secured over said pulleys so as to move in a longitudinal direction over a second side of said deck member when said first pulley is rotated; and a control panel secured to said frame structure and operatively connected to said motor wherein said control panel permits a user to control the speed of said belt.

26. The exercise treadmill of claim 25 wherein said protective coating covers the portion of said first side having said lubricant.

27. The exercise treadmill of claim 25 wherein said protective coating is a self-adhering tape.

28. The exercise treadmill of claim 27 wherein said self-adhering tape is a polyethylene tape.

29. The exercise treadmill of claim 25 wherein said lubricant includes a wax and said protective covering is a self-adhering tape which covers at least substantially all of the area impregnated with said lubricant on said first side of said deck member.

30. The exercise treadmill of claim 5 wherein said tape covers more area on said first side of said deck member than said area of said lubricant impregnated on said first side of said deck member but less than the total area of said area of said first side of said deck member.

* * * * *